US010619422B2

(12) United States Patent
Cao et al.

(10) Patent No.: US 10,619,422 B2
(45) Date of Patent: Apr. 14, 2020

(54) CUTTING TABLES INCLUDING RHENIUM-CONTAINING STRUCTURES, AND RELATED CUTTING ELEMENTS, EARTH-BORING TOOLS, AND METHODS

(71) Applicant: Baker Hughes, a GE company, LLC, Houston, TX (US)

(72) Inventors: Wanjun Cao, The Woodlands, TX (US); Xu Huang, Spring, TX (US); Steven W. Webb, The Woodlands, TX (US)

(73) Assignee: Baker Hughes, A GE Company, LLC, Houston, TX (US)

( * ) Notice: Subject to any disclaimer, the term of this patent is extended or adjusted under 35 U.S.C. 154(b) by 69 days.

(21) Appl. No.: 15/434,634

(22) Filed: Feb. 16, 2017

(65) Prior Publication Data

US 2018/0230754 A1 Aug. 16, 2018

(51) Int. Cl.

| | |
|---|---|
| ***E21B 10/56*** | (2006.01) |
| ***B24D 18/00*** | (2006.01) |
| ***B24D 99/00*** | (2010.01) |
| *E21B 10/55* | (2006.01) |

(52) U.S. Cl.

CPC ..... *E21B 10/56* (2013.01); *B24D 18/0009* (2013.01); *B24D 99/005* (2013.01); *E21B 10/55* (2013.01)

(58) Field of Classification Search

None

See application file for complete search history.

(56) References Cited

U.S. PATENT DOCUMENTS

| | | | | |
|---|---|---|---|---|
| 4,224,380 | A | 9/1980 | Bovenkerk et al. | |
| 4,525,179 | A * | 6/1985 | Gigl | B01J 3/062 51/307 |
| 4,985,051 | A * | 1/1991 | Ringwood | B01J 3/062 51/298 |
| 5,127,923 | A | 7/1992 | Bunting et al. | |
| 5,711,702 | A * | 1/1998 | Devlin | B24D 99/00 175/428 |
| 6,974,624 | B2 | 12/2005 | Mulligan et al. | |
| 7,493,972 | B1 * | 2/2009 | Schmidt | E21B 10/5735 175/432 |
| 8,875,812 | B2 | 11/2014 | Setlur et al. | |

(Continued)

FOREIGN PATENT DOCUMENTS

| | | | |
|---|---|---|---|
| EP | 0029701 | A1 | 6/1981 |
| KR | 1020120114240 | A | 10/2015 |

(Continued)

OTHER PUBLICATIONS

Conversion of gigapascals into kilogram-force/millimeter sqaured. http://translatorcafe.com/unit-converter/en/pressure/5-28/gigapascal-kilogram-force-millimeter-squared (retrieved from World Wide Web on Jun. 23, 2018).*

(Continued)

*Primary Examiner* — Colleen P Dunn
*Assistant Examiner* — Ross J Christie
(74) *Attorney, Agent, or Firm* — TraskBritt

(57) ABSTRACT

A cutting table comprises a polycrystalline hard material and at least one rhenium-containing structure within the polycrystalline hard material and comprising greater than or equal to about 10 weight percent rhenium. A cutting element, an earth-boring tool, and method of forming a cutting element are also described.

18 Claims, 8 Drawing Sheets

(56) References Cited

U.S. PATENT DOCUMENTS

| | | | | |
|---|---|---|---|---|
| 8,939,238 | B2 | 1/2015 | Martensson et al. | |
| 8,968,436 | B2 | 3/2015 | Suryavanshi | |
| 2005/0050801 | A1 | 3/2005 | Cho et al. | |
| 2007/0023206 | A1* | 2/2007 | Keshavan | E21B 10/16 175/374 |
| 2009/0274897 | A1* | 11/2009 | Kaner | B24D 3/00 51/307 |
| 2011/0036641 | A1* | 2/2011 | Lyons | E21B 10/5735 51/307 |
| 2012/0111642 | A1 | 5/2012 | DiGiovanni | |
| 2012/0222363 | A1* | 9/2012 | DiGiovanni | B24D 18/0009 51/307 |
| 2015/0144407 | A1 | 5/2015 | Khabashesku et al. | |
| 2015/0345229 | A1 | 12/2015 | Bird | |
| 2017/0029338 | A1 | 2/2017 | Scott et al. | |

FOREIGN PATENT DOCUMENTS

| | | | |
|---|---|---|---|
| WO | 2005025805 | A1 | 3/2005 |
| WO | 2006099194 | A3 | 9/2006 |
| WO | 2007089590 | A2 | 8/2007 |
| WO | 2008014003 | A2 | 1/2008 |

OTHER PUBLICATIONS

Properties of polycrystalline diamond. http://www.almax-easylab.com/PCD.aspx. (retrieved from World Wide Web on Jun. 23, 2018).*

International Search Report for International Application No. PCT/US2018/016856 dated Jul. 30, 2018, 4 pages.

International Written Opinion for International Application No. PCT/US2018/016856 dated Jul. 30, 2018, 8 pages.

* cited by examiner

CUTTING TABLES INCLUDING RHENIUM-CONTAINING STRUCTURES, AND RELATED CUTTING ELEMENTS, EARTH-BORING TOOLS, AND METHODS

TECHNICAL FIELD

Embodiments of the disclosure relate to cutting tables including rhenium-containing structures, and to related cutting elements, earth-boring tools, and methods of forming the cutting tables, cutting elements, and earth-boring tools.

BACKGROUND

Earth-boring tools for forming wellbores in subterranean formations may include cutting elements secured to a body. For example, a fixed-cutter earth-boring rotary drill bit ("drag bit") may include cutting elements fixedly attached to a bit body thereof. As another example, a roller cone earth-boring rotary drill bit may include cutting elements secured to cones mounted on bearing pins extending from legs of a bit body. Other examples of earth-boring tools utilizing cutting elements include, but are not limited to, core bits, bicenter bits, eccentric bits, hybrid bits (e.g., rolling components in combination with fixed cutting elements), reamers, and casing milling tools.

Cutting elements used in earth-boring tools often include a supporting substrate and a cutting table, the cutting table comprising a volume of superabrasive material, such as a volume of polycrystalline diamond ("PCD") material, on or over the supporting substrate. One or more exposed surfaces of the cutting table act as cutting surfaces of the cutting element. During a drilling operation, cutting edges at least partially defined by adjacent, peripheral portions of the cutting surfaces of the cutting elements are pressed into the formation under force applied through a drill string, such force commonly termed weight on bit (WOB). As the earth-boring tool moves (e.g., rotates) relative to the subterranean formation under WOB, the cutting elements engage surfaces of the subterranean formation and the cutting edges shear away formation material.

During a drilling operation, the cutting elements of an earth-boring tool may be subjected to high temperatures (e.g., due to friction between the cutting table and the subterranean formation being cut), high axial loads (e.g., due to the weight on bit (WOB)), and high impact forces (e.g., due to variations in WOB, formation irregularities, differences in formation materials, vibration, etc.). Such conditions can result in undesirable wear (e.g., dulling) and/or damage (e.g., chipping, spalling) to the cutting tables of the cutting elements. The wear and/or damage often occurs at or near the cutting edges of the cutting tables, and can result in one or more of decreased cutting efficiency, separation of the cutting tables from the supporting substrates of the cutting elements, and separation of the cutting elements from the earth-boring tool to which they are secured.

Accordingly, it would be desirable to have cutting tables, cutting elements, earth-boring tools (e.g., rotary drill bits), and methods of forming and using the cutting tables, the cutting elements, and the earth-boring tools facilitating enhanced cutting efficiency and prolonged operational life during drilling operations as compared to conventional cutting tables, conventional cutting elements, conventional earth-boring tools, and conventional methods of forming and using the conventional cutting tables, the conventional cutting elements, and the conventional earth-boring tools.

BRIEF SUMMARY

Embodiments described herein include cutting elements, earth-boring tools including the cutting elements, and methods of forming the cutting elements. For example, in accordance with one embodiment described herein, a cutting table comprises a polycrystalline hard material and at least one rhenium-containing structure within the polycrystalline hard material and comprising greater than or equal to about 10 weight percent rhenium.

In additional embodiments, a cutting element comprises a supporting substrate and a cutting table over the supporting substrate. The cutting table comprises a polycrystalline hard material and at least one rhenium-containing structure within the polycrystalline hard material and comprising greater than or equal to about 10 weight percent rhenium.

In further embodiments, a method of forming a cutting element comprises providing at least one rhenium-containing structure within a hard material powder comprising discrete hard material particles, the at least one rhenium-containing structure comprising greater than or equal to about 10 weight percent rhenium. A supporting substrate is provided adjacent to the hard material powder. The supporting substrate, the at least one rhenium-containing structure, and the hard material powder are subjected to elevated temperatures and elevated pressures to inter-bond the discrete hard material particles of the hard material powder and form a cutting table attached to the supporting substrate.

DETAILED DESCRIPTION

Figure 1:
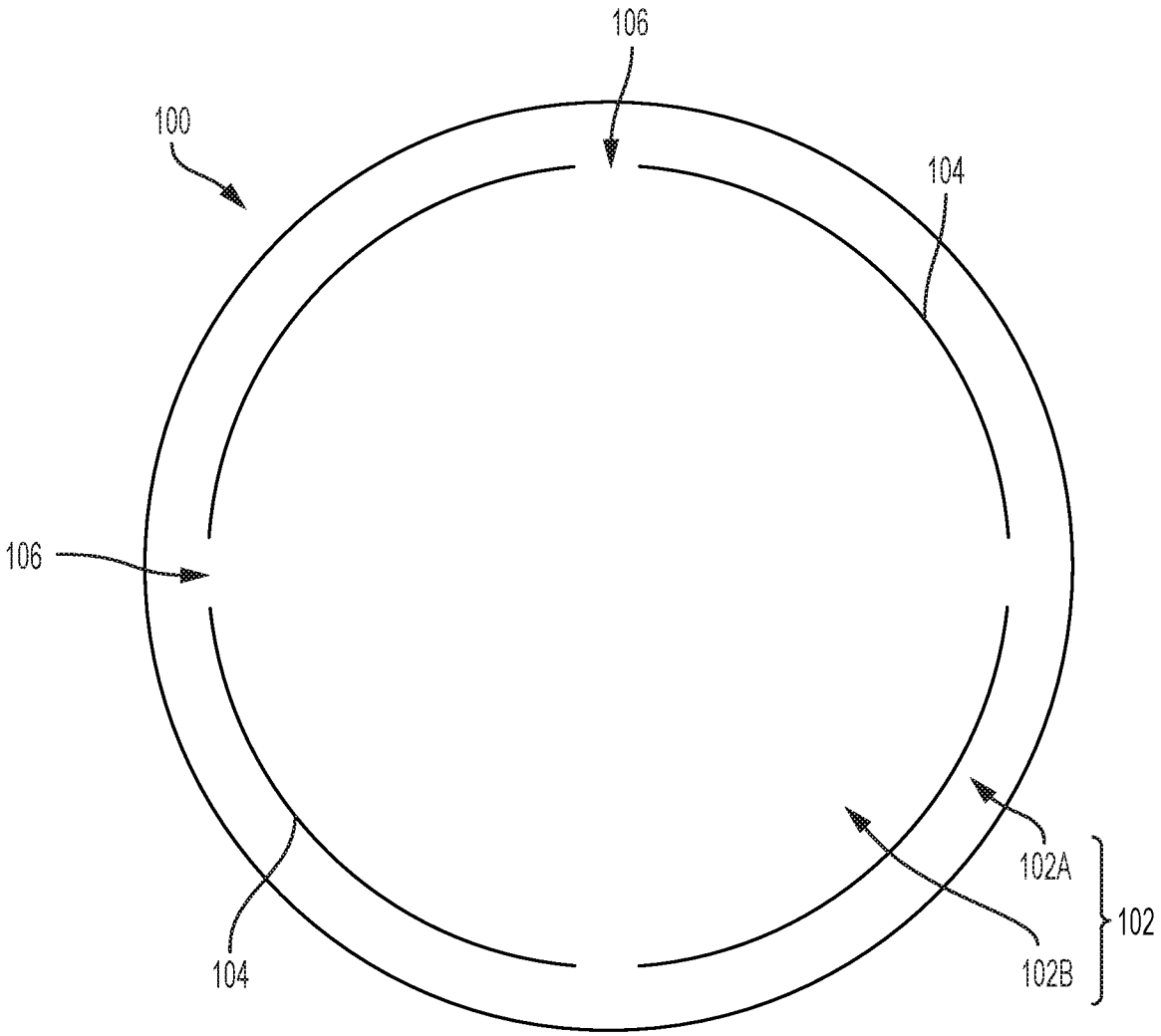
FIGS. 1 through 9 are top-down views of different cutting table configurations, in accordance with embodiments of the disclosure.

Cutting tables and cutting elements for use in earth-boring tools are described, as are earth-boring tools including the cutting elements, and methods of forming and using the cutting tables, the cutting elements, and the earth-boring tools. In some embodiments, a cutting table includes one or more rhenium (Re)-containing structures within a hard material (e.g., a polycrystalline material, such as a PCD material). The Re-containing structures enhance the fracture resistance of the cutting table while also facilitating the controlled fracture of the cutting table at or proximate the Re-containing structure(s) after the cutting table is subjected to a predetermined amount of wear. The fracture of the cutting table may facilitate the selective removal (e.g., detachment) of a section of the cutting table including a worn cutting edge and the formation of a new cutting edge that is relatively sharper than the worn cutting edge. The cutting table is configured to control the amount of wear thereto sufficient to facilitate one or more failure events (e.g., fractures) at or proximate the Re-containing structure(s), and to control the configuration (e.g., size, shape, orientation, etc.) of a new cutting edge thereof formed as a result of the failure event(s). The configurations of the cutting tables, cutting elements, and earth-boring tools described herein may provide enhanced drilling efficiency and improved operational life as compared to the configurations of conventional cutting tables, conventional cutting elements, and conventional earth-boring tools.

The following description provides specific details, such as specific shapes, specific sizes, specific material compositions, and specific processing conditions, in order to provide a thorough description of embodiments of the present disclosure. However, a person of ordinary skill in the art would understand that the embodiments of the disclosure may be practiced without necessarily employing these specific details. Embodiments of the disclosure may be practiced in conjunction with conventional fabrication techniques employed in the industry. In addition, the description provided below does not form a complete process flow for manufacturing a cutting table, a cutting element, or an earth-boring tool. Only those process acts and structures necessary to understand the embodiments of the disclosure are described in detail below. Additional acts to form a complete cutting table, a complete cutting element, or a complete earth-boring tool from the structures described herein may be performed by conventional fabrication processes.

Drawings presented herein are for illustrative purposes only, and are not meant to be actual views of any particular material, component, structure, device, or system. Variations from the shapes depicted in the drawings as a result, for example, of manufacturing techniques and/or tolerances, are to be expected. Thus, embodiments described herein are not to be construed as being limited to the particular shapes or regions as illustrated, but include deviations in shapes that result, for example, from manufacturing. For example, a region illustrated or described as box-shaped may have rough and/or nonlinear features, and a region illustrated or described as round may include some rough and/or linear features. Moreover, sharp angles that are illustrated may be rounded, and vice versa. Thus, the regions illustrated in the figures are schematic in nature, and their shapes are not intended to illustrate the precise shape of a region and do not limit the scope of the present claims. The drawings are not necessarily to scale. Additionally, elements common between figures may retain the same numerical designation.

As used herein, the terms "comprising," "including," "containing," and grammatical equivalents thereof are inclusive or open-ended terms that do not exclude additional, unrecited elements or method steps, but also include the more restrictive terms "consisting of" and "consisting essentially of" and grammatical equivalents thereof. As used herein, the term "may" with respect to a material, structure, feature, or method act indicates that such is contemplated for use in implementation of an embodiment of the disclosure and such term is used in preference to the more restrictive term "is" so as to avoid any implication that other, compatible materials, structures, features, and methods usable in combination therewith should or must be excluded.

As used herein, the terms "longitudinal," "vertical," "lateral," and "horizontal" and are in reference to a major plane of a substrate (e.g., base material, base structure, base construction, etc.) in or on which one or more structures and/or features are formed and are not necessarily defined by earth's gravitational field. A "lateral" or "horizontal" direction is a direction that is substantially parallel to the major plane of the substrate, while a "longitudinal" or "vertical" direction is a direction that is substantially perpendicular to the major plane of the substrate. The major plane of the substrate is defined by a surface of the substrate having a relatively large area compared to other surfaces of the substrate.

As used herein, spatially relative terms, such as "beneath," "below," "lower," "bottom," "above," "over," "upper," "top," "front," "rear," "left," "right," and the like, may be used for ease of description to describe one element's or feature's relationship to another element(s) or feature(s) as illustrated in the figures. Unless otherwise specified, the spatially relative terms are intended to encompass different orientations of the materials in addition to the orientation depicted in the figures. For example, if materials in the figures are inverted, elements described as "over" or "above" or "on" or "on top of" other elements or features would then be oriented "below" or "beneath" or "under" or "on bottom of" the other elements or features. Thus, the term "over" can encompass both an orientation of above and below, depending on the context in which the term is used, which will be evident to one of ordinary skill in the art. The materials may be otherwise oriented (e.g., rotated 90 degrees, inverted, flipped) and the spatially relative descriptors used herein interpreted accordingly.

As used herein, the singular forms "a," "an," and "the" are intended to include the plural forms as well, unless the context clearly indicates otherwise.

As used herein, the term "and/or" includes any and all combinations of one or more of the associated listed items As used herein, the term "configured" refers to a size, shape, material composition, material distribution, orientation, and arrangement of one or more of at least one structure and at least one apparatus facilitating operation of one or more of the structure and the apparatus in a predetermined way.

As used herein, the term "substantially" in reference to a given parameter, property, or condition means and includes to a degree that one of ordinary skill in the art would understand that the given parameter, property, or condition is met with a degree of variance, such as within acceptable manufacturing tolerances. By way of example, depending on the particular parameter, property, or condition that is substantially met, the parameter, property, or condition may be at least 90.0% met, at least 95.0% met, at least 99.0% met, or even at least 99.9% met.

As used herein, the term "about" in reference to a given parameter is inclusive of the stated value and has the meaning dictated by the context (e.g., it includes the degree of error associated with measurement of the given parameter).

As used herein, the terms "earth-boring tool" and "earth-boring drill bit" mean and include any type of bit or tool used for drilling during the formation or enlargement of a wellbore in a subterranean formation and include, for example, fixed-cutter bits, roller cone bits, percussion bits, core bits, eccentric bits, bicenter bits, reamers, mills, drag bits, hybrid bits (e.g., rolling components in combination with fixed cutting elements), and other drilling bits and tools known in the art.

As used herein, the term "polycrystalline compact" means and includes any structure comprising a polycrystalline material formed by a process that involves application of pressure (e.g., compaction) to the precursor material or materials used to form the polycrystalline material. In turn, as used herein, the term "polycrystalline material" means and includes any material comprising a plurality of grains or crystals of the material that are bonded directly together by inter-granular bonds. The crystal structures of the individual grains of the material may be randomly oriented in space within the polycrystalline material.

As used herein, the term "inter-granular bond" means and includes any direct atomic bond (e.g., covalent, metallic, etc.) between atoms in adjacent grains of hard material.

As used herein, the term "hard material" means and includes any material having a Knoop hardness value of greater than or equal to about 3,000 $Kg_f/mm^2$ (29,420 MPa). Non-limiting examples of hard materials include diamond (e.g., natural diamond, synthetic diamond, or combinations thereof), as well as cubic boron nitride.

FIG. 1 illustrates a top-down view of cutting table 100, in accordance with an embodiment of the disclosure. As shown in FIG. 1, the cutting table 100 includes a hard material 102 and one or more Re-containing structures 104 located (e.g., embedded) within the hard material 102. While FIG. 1 depicts a particular cutting table configuration, one of ordinary skill in the art will appreciate that different cutting table configurations are known in the art which may be adapted to be employed in embodiments of the disclosure. Namely, FIG. 1 illustrates a non-limiting example of a cutting table configuration of the disclosure.

The cutting table 100 may exhibit any desired peripheral geometric configuration (e.g., peripheral shape and peripheral size). The peripheral geometric configuration of the cutting table 100 may, for example, be tailored to control one or more of the location(s) of wear to the cutting table 100 during use and operation of the cutting table 100, to control the amounts of wear to the cutting table 100 sufficient to facilitate failure events (e.g., fractures) at or proximate the Re-containing structures 104, and to control the configurations (e.g., sizes, shapes, orientations, etc.) of new cutting edges of the cutting table 100 formed as a result of the failure events. In some embodiments, the cutting table 100 exhibits a circular cylinder shape including a substantially consistent (e.g., substantially uniform, substantially non-variable) circular lateral cross-sectional shape throughout a longitudinal thickness thereof. In additional embodiments, the cutting table 100 exhibits a different peripheral geometric configuration. For example, the cutting table 100 may comprise a three-dimensional (3D) structure exhibiting a substantially consistent lateral cross-sectional shape but variable (e.g., non-consistent, such as increasing and/or decreasing) lateral cross-sectional dimensions throughout the longitudinal thickness thereof, may comprise a 3D structure exhibiting a different substantially consistent lateral cross-sectional shape (e.g., an ovular shape, an elliptical shape, a semicircular shape, a tombstone shape, a crescent shape, a triangular shape, a rectangular shape, a kite shape, an irregular shape, etc.) and substantially consistent lateral cross-sectional dimensions throughout the longitudinal thickness thereof, or may comprise a 3D structure exhibiting a variable lateral cross-sectional shape and variable lateral cross-sectional dimensions throughout the longitudinal thickness thereof.

With continued reference to FIG. 1, the hard material 102 may be formed of and include at least one polycrystalline material, such as a PCD material. For example, the hard material 102 may be formed from diamond particles (also known as "diamond grit") mutually bonded in the presence of at least one catalyst material (e.g., at least one Group VIII metal, such as one or more of cobalt, nickel, and iron; at least one alloy including a Group VIII metal, such as one or more of a cobalt-iron alloy, a cobalt-manganese alloy, a cobalt-nickel alloy, cobalt-titanium alloy, a cobalt-nickel-vanadium alloy, a cobalt-aluminum alloy, an iron-nickel alloy, an iron-nickel-chromium alloy, an iron-manganese alloy, an iron-silicon alloy, a nickel-chromium alloy, and a nickel-manganese alloy; alkali metal carbonates, such as lithium carbonate ($Li_2CO_3$), sodium carbonate ($Na_2CO_3$), potassium carbonate ($K_2CO_3$), etc.; combinations thereof; etc.). The diamond particles may comprise one or more of natural diamond and synthetic diamond, and may include a monomodal distribution or a multimodal distribution of particle sizes. In additional embodiments, the hard material 102 is formed of and includes a different polycrystalline material, such as one or more of polycrystalline cubic boron nitride, and another hard material known in the art. Interstitial spaces between inter-bonded hard material particles (e.g., inter-bonded diamond particles) of the hard material 102 may be at least partially filled with one or more catalyst materials (e.g., cobalt, nickel, iron, another element from Group VIIIA of the Periodic Table of the Elements, alloys thereof, alkali metal carbonates, combinations thereof, etc.) and/or one or more inert metal materials. As used herein, the term "inert metal material" means and includes any metal material (e.g., elemental metal, alloy, etc.) not capable of substantially catalyzing the formation of inter-granular bonds between grains of hard material during an HTHP process. Non-limiting examples of inert metal materials for diamond include zirconium (Zr), hafnium (Hf), niobium (Nb), tantalum (Ta), alloys thereof, and combinations thereof.

The hard material 102 of the cutting table 100 may include a plurality (e.g., two or more) of different regions (e.g., sections) at least partially defined by the configurations and positions of the Re-containing structures 104 of the cutting table 100. By way of non-limiting example, as shown in FIG. 1, the hard material 102 of the cutting table 100 may include a first region 102A and a second region 102B. The first region 102A may be positioned radially outward of the Re-containing structures 104, and the second region 102B may be positioned radially inward of the Re-containing structures 104. The first region 102A may at least partially (e.g., substantially) surround the second region 102B. As depicted in FIG. 1, the first region 102A may substantially circumscribe lateral boundaries (e.g., a lateral periphery) of the second region 102B. Accordingly, the second region 102B may not laterally extend to the outermost lateral boundaries (e.g., sidewall surfaces) of the cutting table 100. In further embodiments, one or more portions (e.g., segments) of the second region 102B may extend to one or more outermost lateral boundaries (e.g., one or more sidewall surfaces) of the cutting table 100. For example, one or more portions of the second region 102B may longitudinally underlie the first region 102A and may laterally extend to one or more outermost lateral boundaries of the cutting table 100, and/or one or more portions of the second region 102B may longitudinally overlie first region 102A and may laterally extend to one or more outermost lateral boundaries of the cutting table 100. In additional embodiments, the hard material 102 may exhibit one or more of different quantities, different configurations, and different positions of the regions thereof.

Each of the different regions (e.g., the first region 102A and the second region 102B) of the hard material 102 may exhibit a microstructure substantially similar to (e.g., having substantially the same average grain size, and substantially the same grain size distribution) that of each other of the different regions of the hard material 102, or at least one of the different regions (e.g., the first region 102A or the second region 102B) of the hard material 102 may exhibit a different microstructure (e.g., a microstructure having a different average grain size and/or a different grain size distribution) than at least one other of the different regions (e.g., the other of first region 102A and the second region 102B) of the hard material 102. For example, the first region 102A may include interspersed and inter-bonded grains of hard material (e.g., inter-bonded diamond grains) having a different average grain size (e.g., a larger average grain size, or a smaller average grain size) than interspersed and inter-bonded grains of hard material (e.g., inter-bonded diamond grains) of the second region 102B, and/or the first region 102A and the second region 102B may include different dispersions (e.g., different mono-modal dispersions, different multi-modal dispersions, a mono-modal dispersion versus a multi-modal dispersion) of the interspersed and inter-bonded grains of hard material thereof. The first region 102A may exhibit a different volume percentage (e.g., a greater volume percentage, or a lower volume percentage) of hard material than the second region 102B, and/or may have a different permeability (e.g., reduced permeability, or greater permeability) than the second region 102B. In additional embodiments, the first region 102A and the second region 102B may exhibit substantially the same volume percentage of hard material as one another, and may have substantially the same permeability as one another.

As shown in FIG. 1, the Re-containing structures 104 are at least partially (e.g., substantially) surrounded by the hard material 102, and at least partially define the shapes and sizes of the different regions of the hard material 102. The Re-containing structures 104 have greater fracture resistance (e.g., greater toughness) than the hard material 102, and increase the probability that the cutting table 100 will fracture (e.g., break, fissure, crack, etc.) at predetermined locations (e.g., at or proximate the Re-containing structures 104) after the cutting table 100 is subject to a predetermined amount of wear. For example, as a cutting edge (or a subsequently-formed cutting edge) of the cutting table 100 engages another structure (e.g., a portion of a subterranean formation) during use and operation, the enhanced fracture resistance of the Re-containing structures 104 (as compared to the hard material 102) may impede or prevent lateral crack propagation therethrough and effectuate the fracture of the cutting table 100 at or proximate boundaries of the Re-containing structures 104 after the cutting edge (or a subsequently-formed cutting edge) has been subjected to a predetermined amount of wear. In turn, detachment (e.g., separation, removal, etc.) of the worn section (e.g., the first region 102A of the hard material 102) of the cutting table 100 may expose at least one of the Re-containing structures 104 and/or another section (e.g., the second region 102B of the hard material 102) of the cutting table 100 and provide a new cutting edge for the cutting table 100. Accordingly, the Re-containing structures 104 of the cutting table 100 may facilitate self-sharpening of the cutting table 100 during use and operation of the cutting table 100. The Re-containing structures 104 may also enhance the general fracture resistance (e.g., toughness) characteristics of the cutting table 100 (e.g., as compared to cutting tables not including the Re-containing structures 104) by forming a ductile material network within the cutting table 100. As described in further detail below, in additional embodiments, one or more portions of the Re-containing structures 104 may be replaced with perforations (e.g., trenches, openings, etc.) in the hard material 102 formed through the removal of the one or more portions of the Re-containing structures 104. The perforations, if present, may facilitate weaknesses and stress concentrations within the cutting table 100 that increase the probability that the cutting table 100 will fracture at or proximate the perforations after the cutting table 100 is subject to a predetermined amount of wear.

The Re-containing structures 104 are formed of and include at least one Re-containing material having a different coefficient of thermal expansion than the hard material 102 of the cutting table 100. The Re-containing material may comprise one or more of elemental (e.g., pure) Re and an Re alloy. In some embodiments, the Re-containing structures 104 are individually formed of and include at least one Re alloy. By way of non-limiting example, the Re-containing structures 104 may individually be formed of and include an Re-containing alloy comprising Re and one or more elements of one or more of Group VIB (e.g., chromium (Cr), molybdenum (Mo), tungsten (W)), Group IVB (e.g., titanium (Ti), zirconium (Zr), hafnium (Hf)), Group VB (e.g., vanadium (V), niobium (Nb), tantalum (Ta)), Group VIIB (e.g., manganese (Mn)), Group VIIIB (e.g., iron (Fe), ruthenium (Ru), osmium (Os), cobalt (Co), rhodium (Rh), iridium (Ir), nickel (Ni), palladium (Pd), platinum (Pt)), Group IIIA (e.g., boron (B), aluminum (Al)), and Group IVA (e.g., carbon (C)) of the Periodic Table of Elements. In some embodiments, the Re-containing alloy comprises Re and at least one refractory metal (e.g., one or more of Nb, Ta, Mo, and W). The Re-containing alloy may include greater than or equal to about 10 weight percent (wt %) Re, such as greater than or equal to about 15 wt % Re, greater than or equal to about 20 wt % Re, greater than or equal to about 30 wt % Re, greater than or equal to about 40 wt % Re, greater than or equal to about 50 wt % Re, greater than or equal to about 60 wt % Re, greater than or equal to about 70 wt % Re, greater than or equal to about 80 wt % Re, or greater than or equal to about 90 wt % Re. In some embodiments, the Re-containing alloy may include greater than or equal to about 20 wt % Re. The Re-containing structures 104 may each individually have a material composition permitting the Re-containing structure 104 to have a melting point greater than or equal to about 1300° C., such as greater than or equal to about 1400° C., or greater than or equal to about 1500° C.

Each of the Re-containing structures 104 of the cutting table 100 may individually include a substantially homogeneous distribution of Re-containing material or a substantially heterogeneous distribution of Re-containing material. As used herein, the term "homogeneous distribution" means amounts of a material do not vary throughout different portions (e.g., different lateral portions and different longitudinal portions) of a structure. Conversely, as used herein, the term "heterogeneous distribution" means amounts of a material vary throughout different portions of a structure. Amounts of the material may vary stepwise (e.g., change abruptly), or may vary continuously (e.g., change progressively, such as linearly, parabolically, etc.) throughout different portions of the structure. In some embodiments, each of the Re-containing structures 104 exhibits a substantially homogeneous distribution of Re-containing material. In additional embodiments, one or more of the Re-containing structures 104 exhibits a substantially heterogeneous distribution of Re-containing material. By way of non-limiting example, one or more of the Re-containing structures 104 may comprise a stack structure including at least two different materials, such as a stack structure including at least one Re-containing material (e.g., Re-containing alloy, elemental Re) over at least one different Re-containing material, or a stack structure including at least one Re-containing material over at least one material substantially free of Re.

Each of the Re-containing structures 104 may have substantially the same material composition and material distribution, or at least one of the Re-containing structures 104 may have a different material composition and/or a different material distribution than at least one other of the Re-containing structures 104. In some embodiments, each of the Re-containing structures 104 exhibits substantially the same material composition and material distribution as each other of the Re-containing structures 104. In additional embodiments, at least one of the Re-containing structures 104 exhibit one or more of a different material composition and a different material distribution than at least one other of the Re-containing structures 104.

Each of the Re-containing structures 104 may individually exhibit a geometric configuration (e.g., dimensions and shape) permitting the cutting table 100 to fail (e.g., fracture, break, fissure, crack, etc.) at or proximate the Re-containing structure 104 after a section of the cutting table 100 radially adjacent (e.g., radially outwardly adjacent) thereto exhibits a predetermined amount of wear during use and operation of the cutting table 100. Each of the Re-containing structures 104 may individually comprise an elongate structure exhibiting a desired cross-sectional shape (e.g., a rectangular cross-sectional shape, a circular cross-sectional shape, an annular cross-sectional shape, a square cross-sectional shapes, a trapezoidal cross-sectional shape, a semicircular cross-sectional shape, a crescent cross-sectional shape, an ovular cross-sectional shape, an ellipsoidal cross-sectional shape, a triangular cross-sectional shape, truncated versions thereof, and an irregular cross-sectional shape). Each of the Re-containing structures 104 may comprise a single, substantially continuous elongate structure (e.g., a single foil, a single sheet, a single wire, a single fiber, a single tube, a single filament, etc.), or one or more of the Re-containing structures 104 may comprise a group (e.g., cluster) of relatively smaller, discrete structures (e.g., discrete Re-containing particles) positioned relative to one another to form a larger elongate structure exhibiting a desired geometric configuration but substantially free of bonds directly coupling the relatively smaller, discrete structures to one another. In some embodiments, the Re-containing structures 104 each individually comprise a single, substantially continuous elongate structure, such as a single foil structure, a single sheet structure, a single wire structure, a single tube structure, or a single filament structure. For example, the Re-containing structures 104 may comprise foil structures formed of and including the Re-containing material. All the Re-containing structures 104 may exhibit substantially the same geometric configuration (e.g., substantially the same shape and substantially the same dimensions), or at least one of the Re-containing structures 104 may exhibit a different geometric configuration (e.g., a different shape and/or one or more different dimensions) than at least one other of the Re-containing structures 104. In some embodiments, each of the Re-containing structures 104 exhibits substantially the same geometric configuration.

With continued referred to FIG. 1, the Re-containing structures 104 may extend in substantially non-linear paths within the hard material 102 of the cutting table 100. For example, the Re-containing structures 104 may extend in arcuate paths (e.g., curved paths) within and across different portions of the hard material 102 of the cutting table 100. As shown in FIG. 1, the arcuate paths of the Re-containing structures 104 may extend substantially parallel to the circumference (e.g., outermost lateral boundaries) of the cutting table 100. In some embodiments, the arcuate paths of at least some (e.g., each) of the Re-containing structures 104 are substantially aligned with the circumferential curvature of the cutting table 100 at a particular radial position. At least some (e.g., each) of the Re-containing structures 104 may be substantially aligned with one another along a single (e.g., only one) radial position, and may circumferentially extend within and across the cutting table 100 at the single radial position. In additional embodiments, one or more of the Re-containing structures 104 may extend in different paths (e.g., substantially linear paths; different substantially non-linear paths, such as different arcuate paths, angled paths, jagged paths, sinusoidal paths, V-shaped paths, U-shaped paths, irregularly shaped paths, combinations thereof, etc.) than those shown in FIG. 1. Non-limiting examples of such different paths are described in further detail below. The different path(s) of the one or more Re-containing structures 104 may, for example, be oriented and extend at least partially (e.g., substantially) non-parallel to the circumference of the cutting table 100. The paths of the Re-containing structures 104 of the cutting table 100 may all exhibit substantially the same shape (e.g., substantially the same non-linear shape, substantially the same linear shape), or at least one of the paths of the Re-containing structures 104 may exhibit a different shape (e.g., a different non-linear shape, a linear shape versus a non-linear shape, etc.) than at least one other of the paths of the Re-containing structures 104.

The Re-containing structures 104 may be separated (e.g., circumferentially separated) from one another by intervening portions 106 of the hard material 102. For example, as shown in FIG. 1, the intervening portions 106 of the hard material 102 may circumferentially extend between Re-containing structures 104 substantially aligned with one another along a single radial position. Each of the Re-containing structures 104 may be circumferentially separated from each other of the Re-containing structures 104 adjacent thereto by substantially the same distance (e.g., such that the Re-containing structures 104 are substantially uniformly circumferentially spaced apart), or at least one of the Re-containing structures 104 may be circumferentially separated from one of the Re-containing structures 104 adjacent thereto by a different distance than that between of the at least one of Re-containing structures 104 and another of the Re-containing structures 104 circumferentially adjacent thereto (e.g., such that the Re-containing structures 104 are non-uniformly circumferentially spaced). The distance between circumferentially adjacent Re-containing structures 104 at least partially depends on the configurations of the Re-containing structures 104, and on the desired fracture resistance and self-sharpening characteristics of the cutting table 100. In some embodiments, the Re-containing structures 104 are substantially uniformly circumferentially spaced. In additional embodiments, the Re-containing structures 104 are non-uniformly circumferentially spaced.

The cutting table 100 may include any quantity and any distribution of the Re-containing structures 104 providing the cutting table 100 with desired fracture resistance characteristics and/or desired self-sharpening characteristics. The quantity and the distribution of the Re-containing structures 104 may at least partially depend on the configurations (e.g., material compositions, material distributions, shapes, sizes, orientations, arrangements, etc.) of the hard material 102 and the Re-containing structures 104. In some embodiments, the cutting table 100 includes greater than or equal to two (2) Re-containing structures 104 (e.g., greater than or equal to three (3) Re-containing structures 104, greater than or equal to five (5) Re-containing structures 104, greater than or equal to ten (10) Re-containing structures 104, etc.). The Re-containing structures 104 may be symmetrically distributed (e.g., symmetrically laterally distributed) within the hard material 102 of the cutting table 100, or may be asymmetrically distributed (e.g., asymmetrically laterally distributed) within hard material 102 of the cutting table 100. In addition, while various embodiments herein describe the cutting table 100 as including multiple (e.g., more than one) Re-containing structures 104, the cutting table 100 may, alternatively, include a single (e.g., only one) Re-containing structure 104.

As previously discussed, while FIG. 1 depicts a particular configuration of the cutting table 100 (e.g., including particular configurations of the hard material 102 and the Re-containing structures 104 thereof), the scope of disclosure is not limited to the cutting table configuration shown in FIG. 1. By way of non-limiting example, in accordance with additional embodiments of the disclosure, FIGS. 2 through 9 show top-down views of cutting tables exhibiting different configurations than that of the cutting table 100 shown in FIG. 1. Throughout the remaining description and the accompanying figures, functionally similar features (e.g., structures) are referred to with similar reference numerals incremented by 100. To avoid repetition, not all features shown in FIGS. 2 through 9 are described in detail herein. Rather, unless described otherwise below, a feature designated by a reference numeral that is a 100 increment of the reference numeral of a previously-described feature (whether the previously-described feature is first described before the present paragraph, or is first described after the present paragraph) will be understood to be substantially similar to the previously-described feature.

Figure 2:
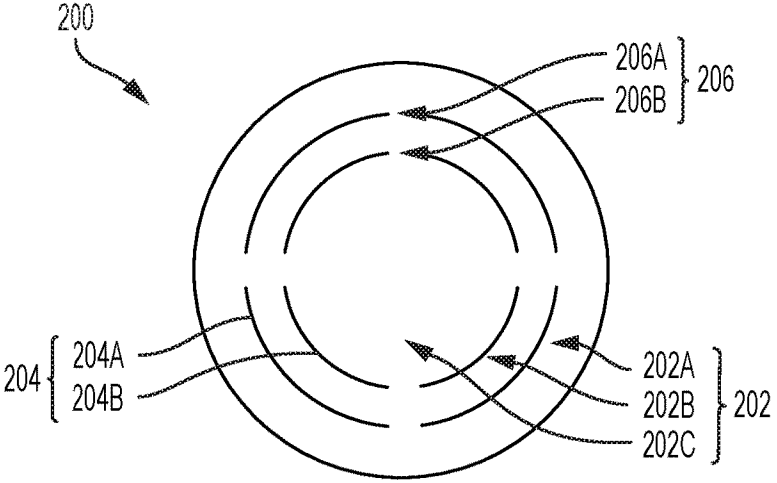

FIG. 2 illustrates a simplified top-down view of a cutting table 200, in accordance with another embodiment of the disclosure. The cutting table 200 is similar to the cutting table 100 shown in FIG. 1, but the cutting table 200 may exhibit at least some Re-containing structures 204 located at different radial positions than at least some other Re-containing structures 204. For example, as shown in FIG. 2, the cutting table 200 may include first Re-containing structures 204A and second Re-containing structures 204B positioned radially inward of the first Re-containing structures 204A. The first Re-containing structures 204A may be substantially aligned with one another along a first radial position, and the second Re-containing structures 204B may be substantially aligned with one another along a second radial position radially inward of the first radial position. The first Re-containing structures 204A may substantially laterally circumscribe the second Re-containing structures 204B. The second Re-containing structures 204B may be nested within the first Re-containing structures 204A. The material compositions, material distributions, shapes, sizes, and orientations of the Re-containing structures 204 (including first Re-containing structures 204A and the second Re-containing structures 204B) may be substantially similar to or may be different than the material compositions, material distributions, shapes, sizes, and orientations of the Re-containing structures 104 previously described with reference to FIG. 1.

As shown in FIG. 2, at least some of the Re-containing structures 204 may be separated from one another by intervening portions 206 of hard material 202. For example, first intervening portions 206A of the hard material 202 may circumferentially extend between the first Re-containing structures 204A, and second intervening portions 206B of the hard material 202 may circumferentially extend between the second Re-containing structures 204B. The first intervening portions 206A may be substantially laterally aligned with and may exhibit substantially the same geometric configurations (e.g., shapes and sizes) as the second intervening portions 206B, or at least some of the first intervening portions 206A may be substantially laterally unaligned with (e.g., laterally offset from) and/or may exhibit different geometric configurations (e.g., different shapes and/or different sizes) than the second intervening portions 206B.

The Re-containing structures 204 may at least partially define different regions of the hard material 202, such as a first region 202A positioned radially outward of the first Re-containing structures 204A, a second region 202B positioned radially between the first Re-containing structures 204A and the second Re-containing structures 204B, and a third region 202C positioned radially inward of the second Re-containing structures 204B. Each of the different regions (e.g., the first region 202A, the second region 202B, and the third region 202C) of the hard material 202 may exhibit a microstructure substantially similar to (e.g., having substantially the same average grain size, and substantially the same grain size distribution) that of each other of the different regions of the hard material 202, or at least one of the different regions (e.g., the first region 202A, the second region 202B, or the third region 202C) of the hard material 202 may exhibit a different microstructure (e.g., a microstructure having a different average grain size and/or a different grain size distribution) than at least one other of the different regions (e.g., another of the first region 202A, the second region 202B, and the third region 202C) of the hard material 202.

In additional embodiments, the cutting table 200 may include additional Re-containing structures located at different radial positions than the first Re-containing structures 204A and the second Re-containing structures 204B. For example, the cutting table 200 may include additional Re-containing structures positioned radially outward of the first Re-containing structures 204A, additional Re-containing structures positioned radially between the first Re-containing structures 204A and the second Re-containing structures 204B, and/or additional Re-containing structures positioned radially inward of the second Re-containing structures 204B. At least some of the additional Re-containing structures may be substantially aligned with one another along a single (e.g., only one) radial position. In addition, the additional Re-containing structures may at least partially define additional regions of the hard material 202. All of the different regions of the hard material 202 may exhibit substantially similar microstructures (e.g., substantially the same average grain size, and substantially the same grain size distribution), or at least some of the different regions of the hard material 202 may exhibit different microstructures (e.g., a different average grain size and/or a different grain size distribution) than at least some other of the different regions of the hard material 202.

Figure 3:
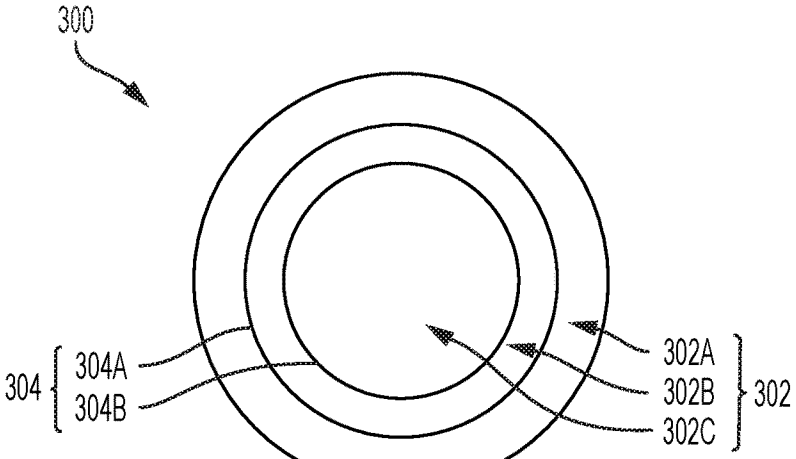

FIG. 3 illustrates a simplified top-down view of a cutting table 300, in accordance with another embodiment of the disclosure. The cutting table 300 is similar to the cutting table 200 shown in FIG. 2, but the cutting table 300 may exhibit Re-containing structures 304 exhibiting different continuity characteristics than those of the Re-containing structures 204 (FIG. 2). For example, as shown in FIG. 3, the cutting table 300 may exhibit a single (e.g., only one) first Re-containing structure 304A circumferentially extending substantially continuously along a first radial position, and a single (e.g., only one) second Re-containing structure 304B circumferentially extending substantially continuously along a second radial position located radially inward of the first radial position. The first Re-containing structure 304A may substantially completely laterally circumscribe the second Re-containing structure 304B. The first Re-containing structure 304A and the second Re-containing structure 304B may, for example, each exhibit substantially continuous, annular shapes, with the second Re-containing structure 304B nested within the first Re-containing structure 304A. The first Re-containing structure 304A may extend substantially continuously in a first circular path in the hard material 302, and the second Re-containing structure 304B may extend substantially continuously in a second circular path in the hard material 302. In additional embodiments, one or more of the first Re-containing structure 304A and the second Re-containing structure 304B may exhibit a different, substantially continuous shape (e.g., a substantially continuous, non-annular shape). In further embodiments, the cutting table 300 may include at least one additional Re-containing structure located at one or more different radial positions than the first Re-containing structure 304A and the second Re-containing structure 304B. For example, the cutting table 300 may include an additional Re-containing structure positioned radially outward of the first Re-containing structure 304A, an additional Re-containing structure positioned radially between the first Re-containing structure 304A and the second Re-containing structure 304B, and/or an additional Re-containing structure positioned radially inward of the second Re-containing structure 304B.

Figure 4:
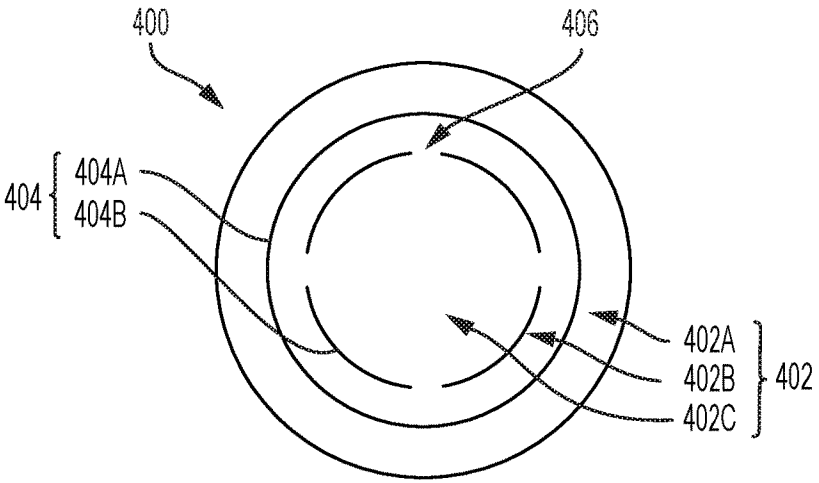

FIG. 4 illustrates a simplified top-down view of a cutting table 400, in accordance with another embodiment of the disclosure. The cutting table 400 is similar to the cutting table 200 shown in FIG. 2, but the cutting table 400 may exhibit one or more Re-containing structures 404 exhibiting different continuity characteristics than one or more other Re-containing structures 404. For example, the cutting table 400 may exhibit a single (e.g., only one) first Re-containing structure 404A circumferentially extending substantially continuously along a first radial position, and multiple (e.g., more than one) discrete second Re-containing structures 404B substantially aligned with one another along a second radial position radially offset from (e.g., radially inward of) the first radial position. In further embodiments, the cutting table 400 may include one or more additional Re-containing structures located at one or more different radial positions than the first Re-containing structure 404A and the second Re-containing structures 404B. For example, the cutting table 400 may include one or more additional Re-containing structures (e.g., a signal Re-containing structure; multiple, aligned Re-containing structures) positioned radially outward of the first Re-containing structure 404A, one or more additional Re-containing structures (e.g., a signal Re-containing structure; multiple, aligned Re-containing structures) positioned radially between the first Re-containing structure 404A and the second Re-containing structures 404B, and/or one or more additional Re-containing structures (e.g., a signal Re-containing structure; multiple, aligned Re-containing structures) positioned radially inward of the second Re-containing structures 404B.

Figure 5:
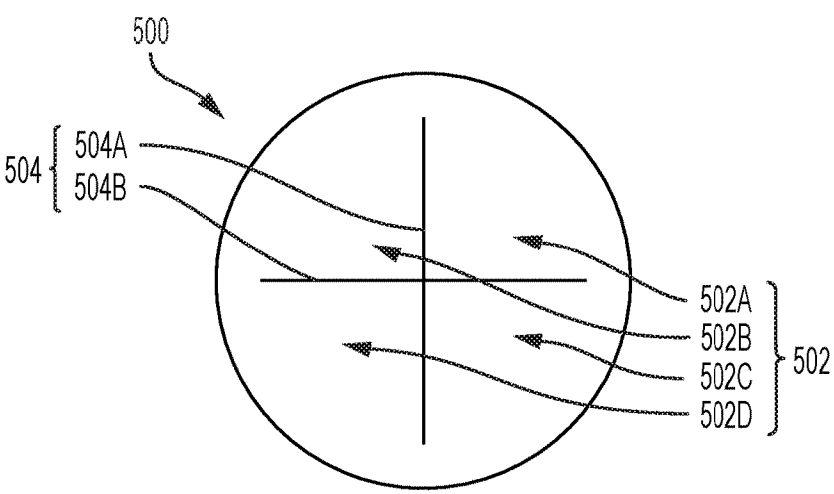

FIG. 5 illustrates a simplified top-down view of a cutting table 500, in accordance with another embodiment of the disclosure. As shown in FIG. 5, the cutting table 500 includes Re-containing structures 504 located within a hard material 502, wherein the Re-containing structures 504 extend in substantially linear paths within and across the hard material 502. The linear paths of the Re-containing structures 504 may laterally extend from or proximate the circumference (e.g., outermost lateral boundaries) of the cutting table 500 to or proximate a lateral center of the cutting table 500. For example, as shown in FIG. 5, the cutting table 500 may include one or more first Re-containing structures 504A laterally inwardly extending toward the lateral center of the cutting table 500 in a first direction, and one or more second Re-containing structures 504B laterally inwardly extending toward the lateral center of the cutting table 500 in a second direction different than the first direction. The linear path of the one or more first Re-containing structures 504A may intersect the linear path of the one or more second Re-containing structures 504B at the lateral center of the cutting table 500. The Re-containing structures 504 may at least partially define different regions of the hard material 502. For example, the first Re-containing structure(s) 504A and the second Re-containing structure(s) 504B may at least partially define a first region 502A, a second region 502B, a third region 502C, and a fourth region 502D of the hard material 502, and each of the different regions (e.g., each of the first region 502A, the second region 502B, the third region 502C, and the fourth region 502D) may individually exhibit a wedge shape. All of the different regions of the hard material 502 may exhibit substantially similar microstructures or at least some of the different regions of the hard material 502 may exhibit different microstructures than at least some other of the different regions of the hard material 502. In additional embodiments, the cutting table 500 may include additional Re-containing structures 504 extending in different linear paths from or proximate the circumference of the cutting table 500 toward a lateral center of the cutting table 500. For example, the cutting table 500 more include one or more Re-containing structures inwardly extending toward the lateral center of the cutting table 500 in at least one additional direction (e.g., a third direction, a fourth direction, etc.) different than the first direction of the first Re-containing structure(s) 504A and the second direction of the second Re-containing structure(s) 504B. In further embodiments, the cutting table 500 may include Re-containing structures 504 extending in a single (e.g., only one) linear path from or proximate the circumference of the cutting table 500 toward a lateral center of the cutting table 500. For example, the first Re-containing structure(s) 504A laterally extending in the first direction may be omitted from the cutting table 500, or the second Re-containing structure(s) 504B laterally extending in the second direction may be omitted from the cutting table 500.

Figure 6:
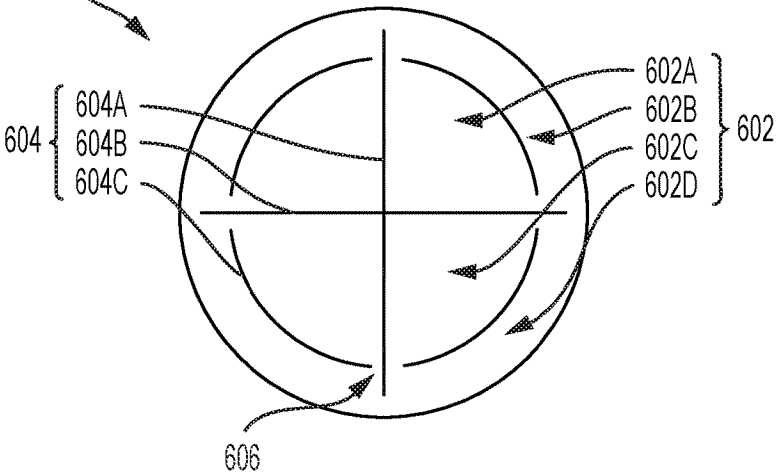

FIG. 6 illustrates a simplified top-down view of a cutting table 600, in accordance with another embodiment of the disclosure. As shown in FIG. 6, the cutting table 600 incorporates (e.g., combines) features of the configurations of the cutting table 100 shown in FIG. 1 and the cutting table 500 shown in FIG. 5. The cutting table 600 may include Re-containing structures 604 extending in substantially linear paths within and across a hard material 602 of the cutting table 600, and other Re-containing structures 604 extending in non-linear paths within across the hard material 602 of the cutting table 600. For example, the cutting table 600 may include one or more first Re-containing structures 604A laterally inwardly extending in a substantially linear path from or proximate the circumference of the cutting table 600 to or proximate a lateral center of the cutting table 600 in a first direction, one or more second Re-containing structures 604B laterally inwardly extending in a substantially linear path from or proximate the circumference of the cutting table 600 to or proximate the lateral center of the cutting table 600 in a second direction different than the first direction, and one or more third Re-containing structures 604C circumferentially extending in a substantially arcuate path along a single (e.g., only one) radial position of the cutting table 600. The Re-containing structures 604 may at least partially define different regions (e.g., a first region 602A, a second region 602B, a third region 602C, a fourth region 602D, etc.) of the hard material 602, wherein all of the different regions may exhibit substantially similar microstructures or at least some of the different regions may exhibit different microstructures than at least some other of the different regions. In additional embodiments, the cutting table 600 may include one or more additional Re-containing structures 604 extending in one or more different linear paths and/or one or more different non-linear paths within and across the hard material 602 of the cutting table 600.

Figure 7:
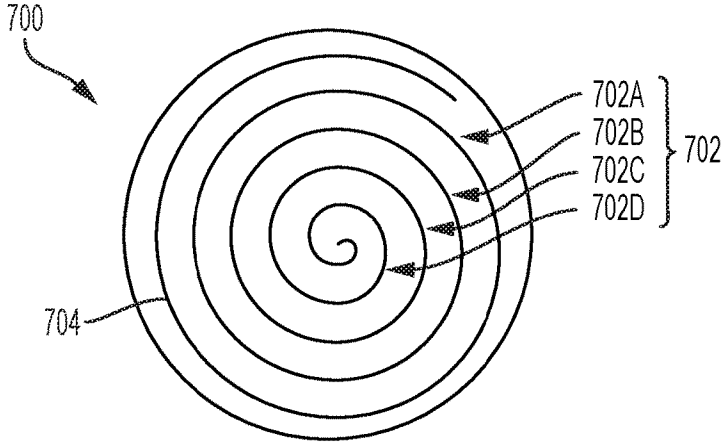

FIG. 7 illustrates a simplified top-down view of a cutting table 700, in accordance with another embodiment of the disclosure. As shown in FIG. 7, the cutting table 700 includes at least one Re-containing structure 704 located within a hard material 702, wherein the Re-containing structure 704 extends in a spiral path within and across the hard material 702 of the cutting table 700. As used herein, the term "spiral path" means and includes an arcuate (e.g., curved) path extending from a location more radially proximate a lateral center of a structure (e.g., the cutting table 700) to another location more radially distal from the lateral center of a structure. The spiral path of the Re-containing structure 704 may extend from or proximate the lateral center of the cutting table 700 to or proximate the circumference (e.g., outermost lateral boundaries) of the cutting table 700. Portions of the Re-containing structure 704 more radially proximate the lateral center of the cutting table 700 may be at least partially (e.g., substantially) laterally circumscribed by other portions of the Re-containing structure 704 more radially distal from the lateral center of the cutting table 700. The Re-containing structure 704 may at least partially define different regions (e.g., a first region 702A, a second region 702B, a third region 702C, a fourth region 702D, etc.) of the hard material 702, wherein all of the different regions may exhibit substantially similar microstructures, or at least some of the different regions may exhibit different microstructures than at least some other of the different regions. In additional embodiments, the cutting table 700 may include one or more additional Re-containing structures 704 extending in one or more different spiral paths within and across the hard material 702 of the cutting table 700.

Figure 8:
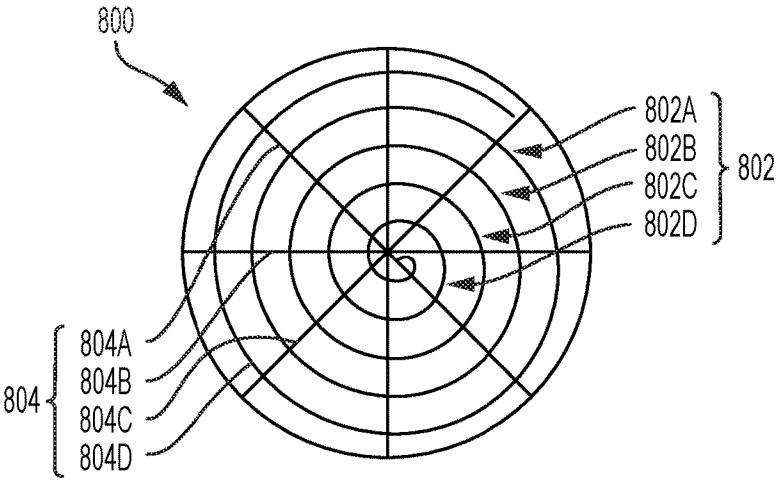

FIG. 8 illustrates a simplified top-down view of a cutting table 800, in accordance with another embodiment of the disclosure. As shown in FIG. 8, the cutting table 800 incorporates (e.g., combines) features of the configurations of the cutting table 500 shown in FIG. 5 and the cutting table 700 shown in FIG. 7. The cutting table 800 may include Re-containing structures 804 extending in substantially linear paths within and across a hard material 802 of the cutting table 800, and at least one other Re-containing structure 804 extending in a spiral path within and across the hard material 802 of the cutting table 800. For example, the cutting table 800 may include one or more first Re-containing structures 804A, one or more second Re-containing structures 804B, and one or more third Re-containing structures 804C laterally inwardly extending in substantially linear paths from or proximate the circumference of the cutting table 800 to or proximate a lateral center of the cutting table 800 in a different directions than one another, and at least one fourth Re-containing structure 804D extending in an spiral path from or proximate the lateral center of the cutting table 800 to or proximate the circumference of the cutting table 800. The Re-containing structures 804 may at least partially define different regions (e.g., a first region 802A, a second region 802B, a third region 802C, a fourth region 802D, etc.) of the hard material 802, wherein all of the different regions may exhibit substantially similar microstructures or at least some of the different regions may exhibit different microstructures than at least some other of the different regions. In additional embodiments, the cutting table 800 may include one or more additional Re-containing structures 804 extending in one or more different linear paths and/or one or more different non-linear paths (e.g., one or more different spiral paths) within and across the hard material 802 of the cutting table 800.

Figure 9:
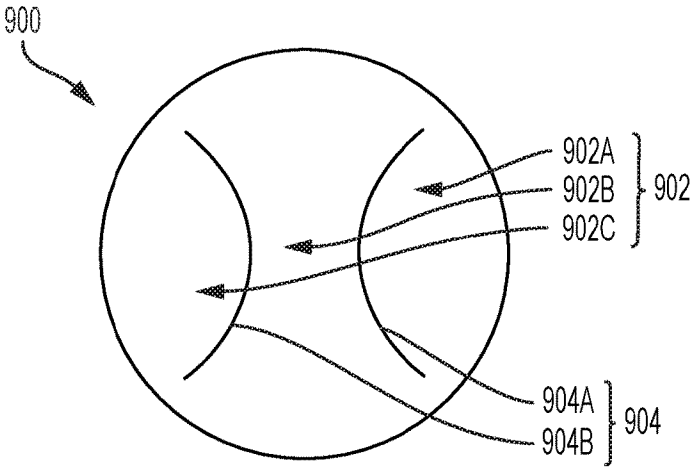

FIG. 9 illustrates a simplified top-down view of a cutting table 900, in accordance with another embodiment of the disclosure. As shown in FIG. 9, the cutting table 900 includes Re-containing structures 904 located within a hard material 902, wherein the Re-containing structures 904 extend within and across the hard material 902 in arcuate paths oriented non-parallel to the circumference of the cutting table 900. For example, the cutting table 900 may include one or more first Re-containing structures 904A extending within and across the hard material 902 in a first arcuate path oriented non-parallel to the circumference of the cutting table 900, and one or more second Re-containing structures 904B extending within and across the hard material 902 in a second arcuate path also oriented non-parallel to the circumference of the cutting table 900. The curvatures of the first arcuate path of the first Re-containing structure(s) 904A and the second arcuate path of second Re-containing structure(s) 904B may, for example, be the inverse of the curvature of the circumference of the cutting table 900. As shown in FIG. 9, in some embodiments, the first arcuate path of the first Re-containing structure(s) 904A may mirror of the second arcuate path of the second Re-containing structure(s) 904B. For example, the first arcuate path of the first Re-containing structure(s) 904A may exhibit substantially the same size and substantially the same shape as the second arcuate path of the second Re-containing structure(s) 904B, but may extend in one or more lateral directions that oppose the one or more lateral directions in which the second arcuate path of the second Re-containing structure(s) 904B laterally extends. In additional embodiments, one or more of the Re-containing structures 904 may extend in different non-linear paths (e.g., different arcuate paths, angled paths, jagged paths, sinusoidal paths, V-shaped paths, U-shaped paths, irregularly shaped paths, combinations thereof, etc.) than those shown in FIG. 9. The Re-containing structures 904 may at least partially define different regions (e.g., a first region 902A, a second region 902B, a third region 902C, etc.) of the hard material 902, wherein all of the different regions may exhibit substantially similar microstructures or at least some of the different regions may exhibit different microstructures than at least some other of the different regions. In additional embodiments, the cutting table 900 may include one or more additional Re-containing structures 904 extending in one or more different non-linear paths (e.g., arcuate paths) within and across the hard material 902 of the cutting table 900.

Along with desired lateral configurations of the components (e.g., the Re-containing structures, the hard material, etc.) thereof, cutting tables according to embodiments of the disclosure may also include desired longitudinal configurations of the components thereof. By way of non-limiting example, in accordance with embodiments of the disclosure, FIGS. 10 through 15 show simplified cross-sectional views of cutting tables exhibiting different longitudinal configurations of the components thereof. The configurations (e.g., longitudinal configurations) of the cutting tables, including the configurations of the Re-containing structures and the hard material thereof, described below with reference to FIGS. 10 through 15 may be employed in conjunction with the configurations (e.g., lateral configurations) of the cutting tables previously described herein with reference to FIGS. 1 through 9.

Figure 10:
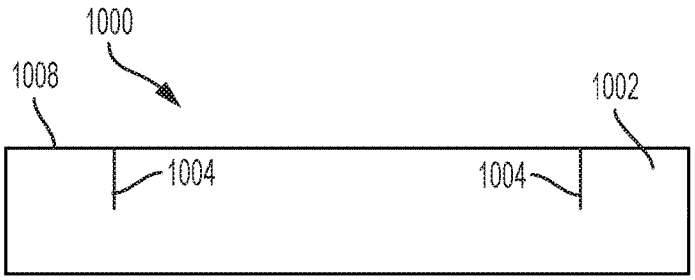
FIGS. 10 through 15 are simplified cross-sectional views of different cutting table configurations, in accordance with embodiments of the disclosure.

FIG. 10 illustrates a simplified cross-sectional view of a cutting table 1000, in accordance with an embodiment of the disclosure. As shown in FIG. 10, the cutting table 1000 includes one or more Re-containing structures 1004 located within a hard material 1002, wherein the Re-containing structures 1004 are located at or substantially longitudinally proximate a cutting surface 1008 of the cutting table 1000. The cutting surface 1008 of the cutting table 1000 may constitute an uppermost longitudinal boundary of the cutting table 1000, and the Re-containing structures 1004 may longitudinally extend into the hard material 1002 of the cutting table 1000 from or substantially proximate to the cutting surface 1008. In some embodiments, the cutting surface 1008 of the cutting table 1000 is at least partially (e.g., substantially) defined by uppermost longitudinal boundaries (e.g., upper surfaces) of the Re-containing structures 1004 and uppermost longitudinal boundaries (e.g., upper surfaces) of the hard material 1002. The uppermost longitudinal boundaries of the Re-containing structures 1004 may be substantially coplanar with the uppermost longitudinal boundaries of the hard material 1002. The Re-containing structures 1004 may individually longitudinally extend to any desired depth within the hard material 1002 facilitating desired fracture resistance and self-sharpening characteristics of the cutting table 1000, such as a depth greater than or equal to about 10 percent (e.g., within a range of from about 10 percent to about 90 percent) of a thickness of the hard material 1002. In addition, as shown in FIG. 10, the Re-containing structures 1004 may be oriented substantially perpendicular to the cutting surface 1008 of the cutting table 1000. In additional embodiments, one or more of the Re-containing structures 1004 may exhibit a different orientation (e.g., a non-perpendicular orientation, such as an angled orientation) relative to the cutting surface 1008 of the cutting table 1000, as described in further detail below.

Figure 11:
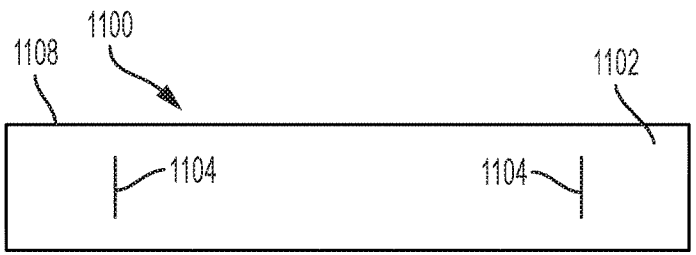

FIG. 11 illustrates a simplified cross-sectional view of a cutting table 1100, in accordance with another embodiment of the disclosure. As shown in FIG. 11, the cutting table 1100 includes one or more Re-containing structures 1104 located within a hard material 1102, wherein the Re-containing structures 1104 are longitudinally offset (e.g., separated, distanced, spaced apart) from a cutting surface 1108 of the cutting table 1100. Portions of the hard material 1102 longitudinally overlie uppermost longitudinal boundaries (e.g., upper surfaces) of the Re-containing structures 1104. Accordingly, the cutting surface 1108 of the cutting table 1100 may be defined by uppermost longitudinal boundaries (e.g., upper surfaces) of the hard material 1102, but not by the uppermost longitudinal boundaries of the Re-containing structures 1104. The Re-containing structures 1004 may individually exhibit any desired longitudinal dimensions (e.g., height) within the hard material 1102 facilitating desired fracture resistance and self-sharpening characteristics of the cutting table 1100, such as a height greater than or equal to about 10 percent (e.g., within a range of from about 10 percent to about 90 percent) of a thickness of the hard material 1102. In addition, the Re-containing structures 1104 may be longitudinally offset from the cutting surface 1108 of the cutting table 1100 by any desired distance. As shown in FIG. 11, in some embodiments, the Re-containing structures 1104 are longitudinally offset from both uppermost longitudinal boundaries (e.g., the cutting surface 1108) and lowermost longitudinal boundaries of the cutting table 1100. In additional embodiments, the Re-containing structures 1104 are longitudinally offset from the uppermost longitudinal boundaries of the cutting table 1100, but lowermost longitudinal boundaries (e.g., lower surfaces) of the Re-containing structures 1104 are substantially coplanar with the lowermost longitudinal boundaries of the cutting table 1100. In further embodiments, the Re-containing structures 1104 are longitudinally offset from the uppermost longitudinal boundaries of the cutting table 1100, but lowermost longitudinal boundaries of the Re-containing structures 1104 longitudinally extend past the lowermost longitudinal boundaries of the cutting table 1100. In addition, as shown in FIG. 11, the Re-containing structures 1104 may be oriented substantially perpendicular to the cutting surface 1108 of the cutting table 1100. In additional embodiments, one or more of the Re-containing structures 1104 may exhibit a different orientation (e.g., a non-perpendicular orientation, such as an angled orientation) relative to the cutting surface 1108 of the cutting table 1100.

Figure 12:
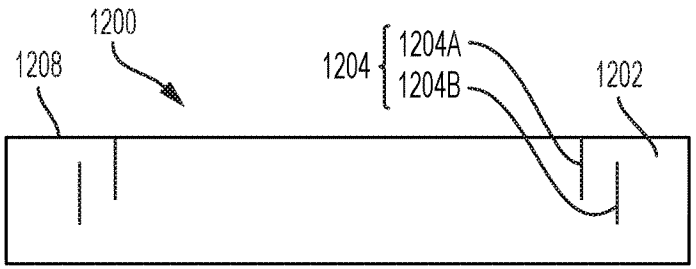

FIG. 12 illustrates a simplified cross-sectional view of a cutting table 1200, in accordance with another embodiment of the disclosure. As shown in FIG. 12, the cutting table 1200 includes Re-containing structures 1204 located within a hard material 1202, wherein some of the Re-containing structures 1204 are located at or substantially longitudinally proximate a cutting surface 1208 of the cutting table 1200 and other of the Re-containing structures 1204 are longitudinally offset (e.g., separated, distanced, spaced apart) from the cutting surface 1208 of the cutting table 1200. For example, one or more first Re-containing structures 1204A may longitudinally extend into the hard material 1202 of the cutting table 1200 from or substantially proximate to the cutting surface 1208, and one or more second Re-containing structures 1204B may longitudinally extend into the hard material 1202 from one or more locations below the cutting surface 1208 such that portions of the hard material 1202 longitudinally overlie uppermost longitudinal boundaries (e.g., upper surfaces) of the second Re-containing structure(s) 1204B. The cutting surface 1208 of the cutting table 1200 may be defined by uppermost longitudinal boundaries of the first Re-containing structure(s) 1204A and uppermost longitudinal boundaries (e.g., upper surfaces) of the hard material 1202, but not by the uppermost longitudinal boundaries of the second Re-containing structure(s) 1204B. The first Re-containing structure(s) 1204A and the second Re-containing structure(s) 1204B may individually exhibit any longitudinal dimensions (e.g., height) facilitating desired fracture resistance and self-sharpening characteristics of the cutting table 1200, such as a height greater than or equal to about 10 percent (e.g., within a range of from about 10 percent to about 90 percent) of a thickness of the hard material 1202. In addition, the second Re-containing structure(s) 1204B may be longitudinally offset from the cutting surface 1208 of the cutting table 1200 by any desired distance. The second Re-containing structure(s) 1204B may be longitudinally offset from both uppermost longitudinal boundaries (e.g., the cutting surface 1208) and lowermost longitudinal boundaries of the cutting table 1200, may be longitudinally offset from the uppermost longitudinal boundaries of the cutting table 1200 but may have lowermost longitudinal boundaries (e.g. lower surfaces) that are substantially coplanar with the lowermost longitudinal boundaries of the cutting table 1200, and/or may be longitudinally offset from the uppermost longitudinal boundaries of the cutting table 1200 but may have lowermost longitudinal boundaries that longitudinally extend past the lowermost longitudinal boundaries of the cutting table 1200. Furthermore, as shown in FIG. 12, the Re-containing structures 1204 may be oriented substantially perpendicular to the cutting surface 1208 of the cutting table 1200. In additional embodiments, one or more of the Re-containing structures 1204 (e.g., the first Re-containing structures 1204A and/or the second Re-containing structures 1204B) may exhibit a different orientation (e.g., a non-perpendicular orientation, such as an angled orientation) relative to the cutting surface 1208 of the cutting table 1200.

Figure 13:
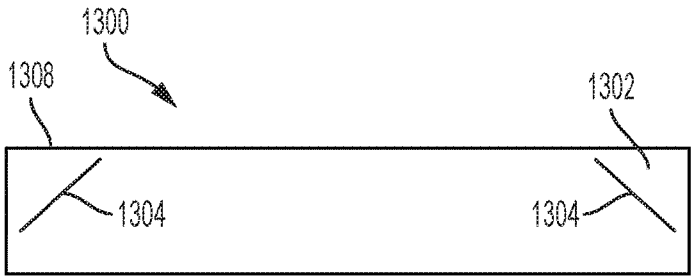

FIG. 13 illustrates a simplified cross-sectional view of a cutting table 1300, in accordance with another embodiment of the disclosure. As shown in FIG. 13, the cutting table 1300 includes one or more Re-containing structures 1304 located within a hard material 1302, wherein the Re-containing structure(s) 1304 exhibit a non-perpendicular orientation relative to a cutting surface 1308 of the cutting table 1300. For example, the Re-containing structure(s) 1304 may be oriented at one or more acute angles relative to the cutting surface 1308 of the cutting table 1300, such as at least one angle between 0 degrees and 90 degrees (e.g., from about 5 degrees to about 85 degrees, from about 10 degrees to about 75 degrees, from about 15 degrees to about 60 degrees, or from about 30 degrees to about 45 degrees). The angle(s) of Re-containing structure(s) 1304 may be selected at least partially based on desired cutting edge characteristics of the cutting table 1300 following a predetermined amount of wear. In some embodiments, the Re-containing structure(s) 1304 are oriented at an angle of about 45 degrees relative to the cutting surface 1308 of the cutting table 1300. The Re-containing structure(s) 1304 may exhibit any height facilitating desired fracture resistance and self-sharpening characteristics of the cutting table 1300, such as a height greater than or equal to about 10 percent (e.g., within a range of from about 10 percent to about 90 percent) of a thickness of the hard material 1302. In addition, each of the Re-containing structure(s) 1304 may be located at or substantially longitudinally proximate the cutting surface 1308, or at least one of the Re-containing structure(s) 1304 may be longitudinally offset from the cutting surface 1308 of the cutting table 1300 by a desired distance.

Figure 14:
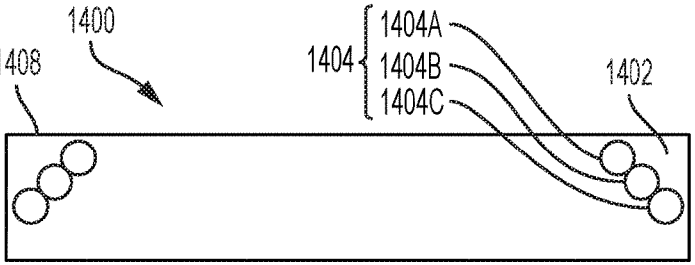

FIG. 14 illustrates a simplified cross-sectional view of a cutting table 1400, in accordance with another embodiment of the disclosure. As shown in FIG. 14, the cutting table 1400 includes Re-containing structures 1404 located within a hard material 1402, wherein the Re-containing structures 1404 are positioned relative to one another within the hard material 1402 to form groupings (e.g., clusters) of the Re-containing structure(s) 1404 that together exhibit a non-perpendicular orientation relative to a cutting surface 1408 of the cutting table 1400. For example, the cutting table 1400 may include one or more first Re-containing structures 1404A (e.g., first Re-containing wires) longitudinally extending into the hard material 1402 from or substantially proximate to a cutting surface 1408, one or more second Re-containing structures 1404B (e.g., second Re-containing wires) provided within the hard material 1402 at one or more locations longitudinally below and laterally outward of the first Re-containing structure(s) 1404A, and one or more third Re-containing structures 1404C (e.g., third Re-containing wires) provided within the hard material 1402 at one or more locations longitudinally below and laterally outward of the second Re-containing structure(s) 1404B. The Re-containing structures 1404 may exhibit any suitable cross-sectional configuration including, without limitation, circular, non-circular elliptical, triangular, square, rectangular or other polygon, etc. Further, the Re-containing structures 1404 may be of varying, different cross-sectional shapes and/or areas along lengths thereof. In additional embodiments, the cutting table 1400 may exhibit different quantities, positions, and/or arrangements of the Re-containing structures 1404. The groupings of the Re-containing structures 1404 (e.g., the groupings of the first Re-containing structure(s) 1404A, the second Re-containing structure(s) 1404B, and the third Re-containing structure(s) 1404C) may be oriented at one or more acute angles relative to the cutting surface 1408 of the cutting table 1400, such as at least one angle between 0 degrees and 90 degrees (e.g., from about 5 degrees to about 85 degrees, from about 10 degrees to about 75 degrees, from about 15 degrees to about 60 degrees, or from about 30 degrees to about 45 degrees). In additional embodiments, the groupings of the Re-containing structures 1404 are oriented perpendicular to the cutting surface 1408 of the cutting table 1400.

Figure 15:
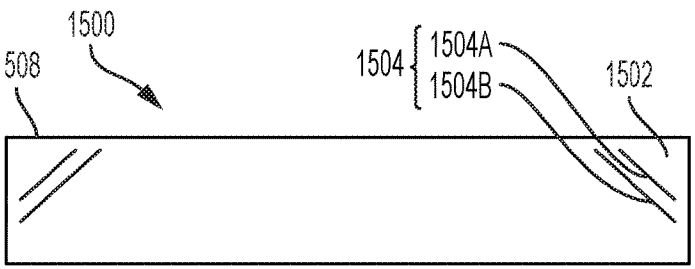

FIG. 15 illustrates a simplified cross-sectional view of a cutting table 1500, in accordance with another embodiment of the disclosure. As shown in FIG. 15, the cutting table 1500 includes Re-containing structures 1504 located within a hard material 1502, wherein the Re-containing structures 1504 exhibit one of more non-perpendicular orientations relative to a cutting surface 1508 of the cutting table 1500 and at least some of the Re-containing structures 1504 longitudinally overlie at least a portion of at least some other of the Re-containing structures 1504. For example, the cutting table 1500 may include one or more first Re-containing structures 1504A (e.g., first Re-containing foils, first Re-containing sheets, etc.) extending into the hard material 1502 at one or more acute angles relative to the cutting surface 1508 of the cutting table 1500, and one or more second Re-containing structures 1504B (e.g., second Re-containing foils, second Re-containing sheets, etc.) at least partially longitudinally underlying the first Re-containing structure(s) 1504A and also extending into the hard material 1502 at one or more acute angles relative to the cutting surface 1508 of the cutting table 1500. In additional embodiments, the cutting table 1500 may exhibit different quantities, positions, orientations, and/or arrangements of the Re-containing structures 1504. The positions and orientations of Re-containing structures 1504 (e.g., the first Re-containing structure(s) 1504A and the second Re-containing structure(s) 1504B) may be selected at least partially based on desired cutting edge characteristics of the cutting table 1500 following a predetermined amount of wear. The Re-containing structures 1504 may each individually be oriented at an angle between 0 degrees and 90 degrees (e.g., from about 5 degrees to about 85 degrees, from about 10 degrees to about 75 degrees, from about 15 degrees to about 60 degrees, or from about 30 degrees to about 45 degrees). The Re-containing structures 1504 may individually exhibit any height facilitating desired fracture resistance and self-sharpening characteristics of the cutting table 1500, such as a height greater than or equal to about 10 percent (e.g., within a range of from about 10 percent to about 90 percent) of a thickness of the hard material 1502. In addition, each of the Re-containing structures 1504 may be located at or substantially longitudinally proximate the cutting surface 1508, or at least one of the Re-containing structures 1504 may be longitudinally offset from the cutting surface 1508 of the cutting table 1500 by a desired distance.

Cutting tables according to embodiments of the disclosure may also include one or more regions wherein catalyst material (e.g., Co, Fe, Ni, another element from Group VIIIA of the Periodic Table of the Elements, alloys thereof, alkali metal carbonates, combinations thereof, etc.) is not present within interstitial spaces between inter-bonded particles (e.g., inter-bonded diamond particles) of the hard material thereof. The catalyst material may, for example, have been removed (e.g., leached) from the one or more regions following the formation of the cutting table, as described in further detail below. The regions free of catalyst material may enhance the thermal stability of the cutting table relative to cutting table configurations not including the regions free of catalyst material. By way of non-limiting example, in accordance with embodiments of the disclosure, FIGS. 16 through 20 show simplified cross-sectional views of cutting tables exhibiting regions (e.g., leached regions) substantially free of catalyst material. The configurations of the cutting tables described below with reference to FIGS. 16 through 20 may be employed in conjunction with the configurations of the cutting tables previously described herein with reference to FIGS. 1 through 15.

Figure 16:
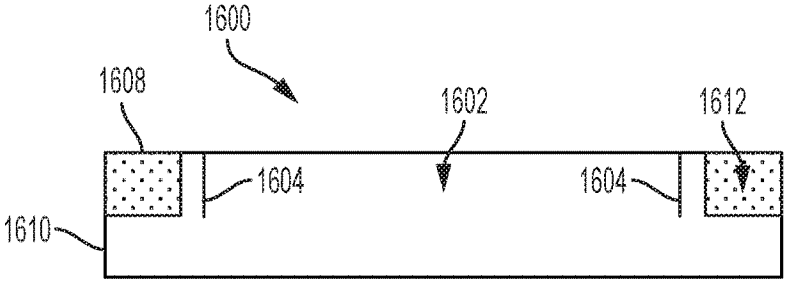

FIG. 16 illustrates a simplified cross-sectional view of a cutting table 1600, in accordance with another embodiment of the disclosure. As shown in FIG. 16, the cutting table 1600 includes one or more Re-containing structures 1604 located within a hard material 1602, and one or more substantially catalyst-free regions 1612 (e.g., leached regions) located laterally outward of the Re-containing structure(s) 1604. For example, the substantially catalyst-free region(s) 1612 may individually inwardly laterally extend from a sidewall surface 1610 of the cutting table 1600 to or proximate (e.g., substantially proximate) the Re-containing structure(s) 1604. The substantially catalyst-free region(s) 1612 may also inwardly longitudinally extend from a cutting surface 1608 of the cutting table 1600. Accordingly, the substantially catalyst-free region(s) 1612 may partially (e.g., less than completely) laterally extend across and partially define the cutting surface 1608 of the cutting table 1600. Lowermost longitudinal boundaries of the substantially catalyst-free region(s) 1612 may be located longitudinally above lowermost longitudinal boundaries (e.g., lower surfaces) of the Re-containing structure(s) 1604, may be substantially coplanar with the lowermost longitudinal boundaries of the Re-containing structure(s) 1604, and/or may be located longitudinally below the lowermost longitudinal boundaries of the Re-containing structure(s) 1604.

Figure 17:
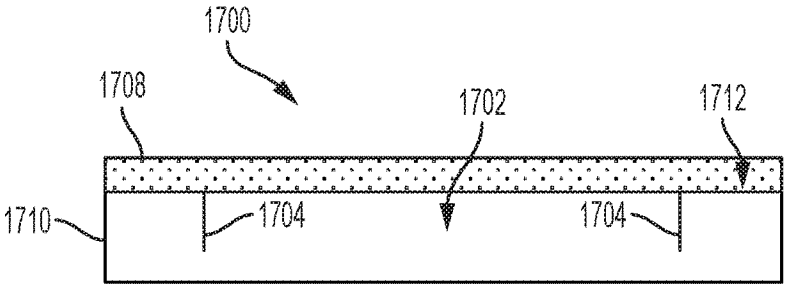

FIG. 17 illustrates a simplified cross-sectional view of a cutting table 1700, in accordance with another embodiment of the disclosure. As shown in FIG. 17, the cutting table 1700 includes one or more Re-containing structures 1704 located within a hard material 1702, and a substantially catalyst-free region 1712 (e.g., a leached region) located longitudinally above and laterally outward of the Re-containing structure(s) 1704. The substantially catalyst-free region 1712 may inwardly longitudinally extend from a cutting surface 1708 of the cutting table 1700 to or substantially proximate uppermost longitudinal boundaries (e.g., upper surfaces) of the Re-containing structure(s) 1704. The substantially catalyst-free region 1712 may also extend substantially completely across the cutting surface 1708 of the cutting table 1700. Accordingly, uppermost longitudinal boundaries of the substantially catalyst-free region 1712 may define the cutting surface 1708 of the cutting table 1700. Lowermost longitudinal boundaries of the substantially catalyst-free region 1712 may be located longitudinally above the uppermost longitudinal boundaries of the Re-containing structure(s) 1704, and/or may be substantially coplanar with the uppermost longitudinal boundaries of the Re-containing structure(s) 1704.

Figure 18:
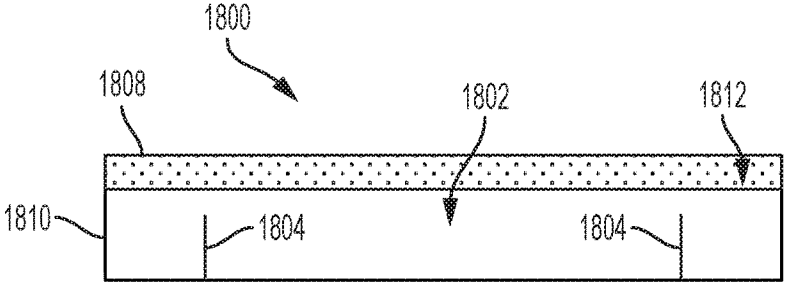

FIG. 18 illustrates a simplified cross-sectional view of a cutting table 1800, in accordance with another embodiment of the disclosure. As shown in FIG. 18, the cutting table 1800 includes one or more Re-containing structures 1804 located within a hard material 1802, and a substantially catalyst-free region 1812 (e.g., a leached region) located longitudinally above and laterally outward of the Re-containing structure(s) 1804. The substantially catalyst-free region 1812 may inwardly longitudinally extend from a cutting surface 1808 of the cutting table 1800 to one or more locations longitudinally above uppermost longitudinal boundaries (e.g., upper surfaces) of the Re-containing structure(s) 1804, such that portions of the hard material 1802 longitudinally intervene between the uppermost longitudinal boundaries of the Re-containing structure(s) 1804 and lowermost longitudinal boundaries of the substantially catalyst-free region 1812. The substantially catalyst-free region 1812 may also extend substantially completely across the cutting surface 1808 of the cutting table 1800. Accordingly, uppermost longitudinal boundaries of the substantially catalyst-free region 1812 may define the cutting surface 1808 of the cutting table 1800.

Figure 19:
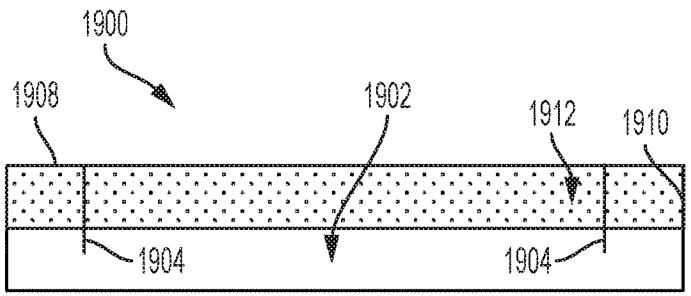
FIGS. 16 through 20 are simplified cross-sectional views of different leached cutting table configurations, in accordance with embodiments of the disclosure.

FIG. 19 illustrates a simplified cross-sectional view of a cutting table 1900, in accordance with another embodiment of the disclosure. As shown in FIG. 19, the cutting table 1900 includes one or more Re-containing structures 1904 located within a hard material 1902, and a substantially catalyst-free region 1912 (e.g., a leached region) at least partially surrounding (e.g., at least partially laterally surrounding, at least partially longitudinally surrounding) the Re-containing structure(s) 1904. The substantially catalyst-free region 1912 may inwardly longitudinally extend from a cutting surface 1908 of the cutting table 1900 to one or more locations longitudinally below the uppermost longitudinal boundaries (e.g., upper surfaces) of the Re-containing structure(s) 1904. The substantially catalyst-free region 1912 may also extend across the cutting surface 1908 of the cutting table 1900. Accordingly, uppermost boundaries of the substantially catalyst-free region 1912 may at least partially define the cutting surface 1908 of the cutting table 1900. Lowermost longitudinal boundaries of the substantially catalyst-free region 1912 may be located longitudinally above lowermost longitudinal boundaries (e.g., lower surfaces) of the Re-containing structure(s) 1904, may be substantially coplanar with the lowermost longitudinal boundaries of the Re-containing structure(s) 1904, and/or may be located longitudinally below the lowermost longitudinal boundaries of the Re-containing structure(s) 1904.

Figure 20:
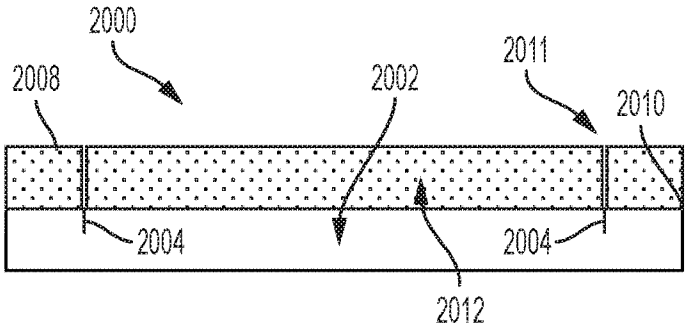

FIG. 20 illustrates a simplified cross-sectional view of a cutting table 2000, in accordance with another embodiment of the disclosure. The cutting table 2000 is similar to the cutting table 1900 shown in FIG. 19, but the cutting table 2000 may exhibit one or more perforations 2011 (e.g., openings, trenches) in the substantially catalyst-free region 2012 corresponding to portions of the Re-containing structures 2004 removed (e.g., leached) during the formation of the substantially catalyst-free region 2012. As shown in FIG. 20, lowermost boundaries of the perforations 2011 and the substantially catalyst-free region 2012 may be positioned longitudinally at or above uppermost longitudinal boundaries (e.g., upper surfaces) of remaining portions of the Re-containing structures 2004. In additional embodiments, remaining portions of the Re-containing structures 2004 may be absent (e.g., omitted) from the cutting table 2000. For example, the formation of the substantially catalyst-free region 2012 may completely replace the Re-containing structures 2004 with the perforations 2011. The perforations 2011 may impede or prevent undesired lateral crack propagation across the cutting table 2000.

Figure 21:
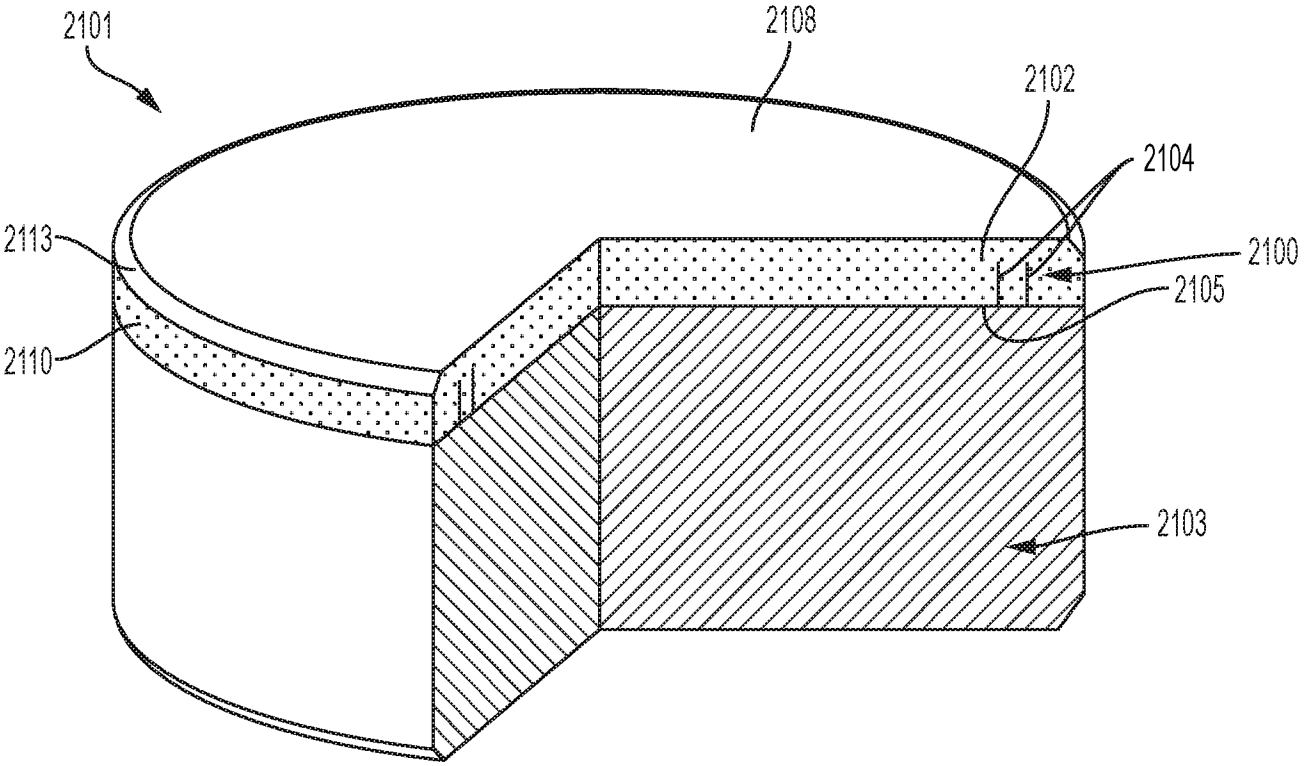
FIG. 21 is a partial cut-away perspective view of a cutting element, in accordance with an embodiment of the disclosure.

Cutting tables (e.g., the cutting tables 100 through 2000 respectively shown in FIGS. 1 through 20) according to embodiments of the disclosure may be included in cutting elements of the disclosure. For example, in accordance with embodiments of the disclosure, FIG. 21 illustrates a cutting element 2101. The cutting element 2101 includes a supporting substrate 2103, and a cutting table 2100 attached (e.g., bonded, coupled, adhered) to the supporting substrate 2103 at an interface 2105. While FIG. 21 depicts a particular cutting element configuration, one of ordinary skill in the art will appreciate that different cutting element configurations are known in the art which may be adapted to be employed in embodiments of the disclosure. Namely, FIG. 21 illustrates a non-limiting example of a cutting element configuration of the disclosure.

The supporting substrate 2103 may be formed of and include a material that is relatively hard and resistant to wear. By way of non-limiting example, the supporting substrate 2103 may be formed from and include a ceramic-metal composite material (also referred to as a "cermet" material). In some embodiments, the supporting substrate 2103 is formed of and includes a cemented carbide material, such as a cemented tungsten carbide material, in which tungsten carbide particles are cemented together in a metallic binder material. As used herein, the term "tungsten carbide" means any material composition that contains chemical compounds of tungsten and carbon, such as, for example, WC, $W_2C$, and combinations of WC and $W_2C$. Tungsten carbide includes, for example, cast tungsten carbide, sintered tungsten carbide, and macrocrystalline tungsten carbide. The metallic binder material may include, for example, a catalyst material such as cobalt, nickel, iron, or alloys and mixtures thereof. In some embodiments, the supporting substrate 2103 is formed of and includes a cobalt-cemented tungsten carbide material.

The supporting substrate 2103 may exhibit any desired peripheral geometric configuration (e.g., peripheral shape and peripheral size) suitable to provide mechanical support to cutting table 2100 during drilling under WOB and applied rotation to the earth-boring tool carrying the cutting element 2101. The supporting substrate 2103 may, for example, exhibit a peripheral shape and a peripheral size at least partially complementary to (e.g., substantially similar to) a peripheral geometric configuration of at least a portion of the cutting table 2100 thereon or thereover. The peripheral shape and the peripheral size of the supporting substrate 2103 may also be configured to permit the supporting substrate 2103 to be received within and/or located upon an earth-boring tool, as described in further detail below. By way of non-limiting example, as shown in FIG. 21, the supporting substrate 2103 may exhibit a circular cylinder shape. In additional embodiments, the supporting substrate 2103 may exhibit a different peripheral shape (e.g., a conical shape; a frustoconical shape; truncated versions thereof; or an irregular shape, such as a complex shape complementary to both of the cutting table 2100 thereon or thereover and a recess or socket in an earth-boring tool to receive and hold the supporting substrate 2103). In addition, the interface 2105 between the supporting substrate 2103 and the cutting table 2100 (and, hence, opposing surfaces of the supporting substrate 2103 and the cutting table 2100) may be substantially planar, or may be non-planar (e.g., curved, angled, jagged, sinusoidal, V-shaped, U-shaped, irregularly shaped, combinations thereof, etc.).

The cutting table 2100 may be disposed on or above the supporting substrate 2103, and may include a hard material 2102 and one or more Re-containing structures 2104 located within the hard material 2102. In addition, the cutting table 2100 may exhibit at least one sidewall surface 2110, and a cutting surface 2108 opposite the interface 2105 between the supporting substrate 2103 and the cutting table 2100. The cutting table 2100 may also exhibit at least one chamfered edge 2113 (and/or at least one arcuate edge) at a periphery of the cutting surface 2108. The configuration of the cutting table 2100, including the configurations of the hard material 2102 and the Re-containing structure(s) 2104 thereof, may be substantially similar to the configuration of one of the cutting tables 100, 200, 300, 400, 500, 600, 700, 800, 900, 1000, 1100, 1200, 1300, 1400, 1500, 1600, 1700, 1800, 1900, 2000 previously described herein with reference to FIGS. 1 through 20, respectively. As shown in FIG. 21, in some embodiments, lowermost longitudinal boundaries (e.g., lower surfaces) of the Re-containing structure(s) 2104 may terminate at and/or above the interface 2105 between the supporting substrate 2103 and the cutting table 2100. In additional embodiments, the lowermost longitudinal boundaries of the Re-containing structure(s) 2104 may be located longitudinally below the interface 2105 between the supporting substrate 2103 and the cutting table 2100. For example, the Re-containing structure(s) 2104 may longitudinally extend into the supporting substrate 2103 from the cutting table 2100. Longitudinally extending the Re-containing structure(s) 2104 into the supporting substrate 2103 may, for example, enhance the adhesion of the cutting table 2100 to the supporting substrate 2103 by reducing abrupt property (e.g., thermal expansion coefficient, young's modulus, etc.) transitions between the supporting substrate 2103 and the cutting table 2100.

An embodiment of a method of forming a cutting element (e.g., the cutting element 2101 shown in FIG. 21) of the disclosure will now be described with reference to FIGS. 22A and 22B, which are simplified cross-sectional views illustrating a container in a process of forming a cutting element. With the description provided below, it will be readily apparent to one of ordinary skill in the art that the methods described herein may be used in various devices. In other words, the methods of the disclosure may be used whenever it is desired to form a cutting element including a cutting table attached to a substrate.

Figure 22B:
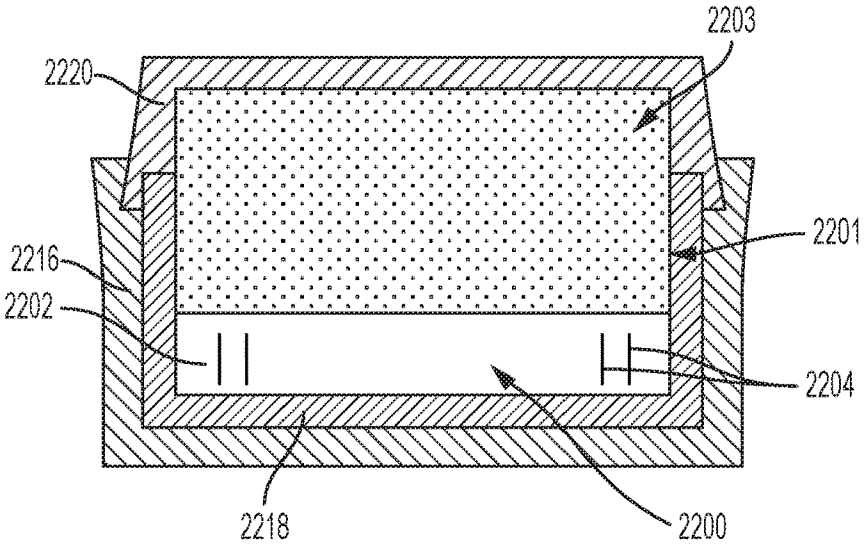
FIGS. 22A and 22B are simplified cross-sectional views of a container in a process of forming a cutting element, in accordance with embodiments of the disclosure.
Figure 22A:
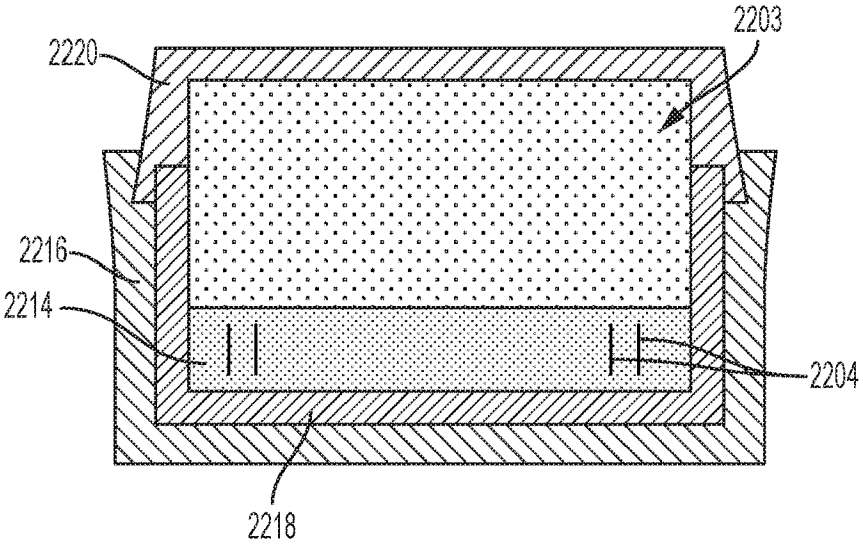

Referring to FIG. 22A, a hard material powder 2214 (e.g., diamond powder) having one or more Re-containing structures 2204 disposed therein may be provided within the container, and a supporting substrate 2203 may be provided on or over the hard material powder 2214. The container may substantially surround and hold the hard material powder 2214, the Re-containing structures 2204, and the supporting substrate 2203. As shown in FIG. 22A, the container may include an inner cup 2218 in which the hard material powder 2214, the Re-containing structures 2204, and a portion of the supporting substrate 2203 may be disposed, a bottom end piece 2216 in which the inner cup 2218 may be at least partially disposed, and a top end piece 2220 surrounding the supporting substrate 2203 and coupled (e.g., swage bonded) to one or more of the inner cup 2218 and the bottom end piece 2216. In additional embodiments, the bottom end piece 2216 may be omitted (e.g., absent).

The hard material powder 2214 may be formed of and include discrete hard material particles (e.g., discrete diamond particles, such as natural diamond particles, discrete synthetic diamond particles, combinations thereof, etc.). The discrete hard material particles may individually exhibit a desired grain size. The discrete hard material particles may comprise, for example, one or more of micro-sized hard material particles and nano-sized hard material particles. In addition, each of the discrete hard material particles may individually exhibit a desired shape, such as at least one of a spherical shape, a hexahedral shape, an ellipsoidal shape, a cylindrical shape, a conical shape, or an irregular shape. In some embodiments, each of the discrete hard material particles of the hard material powder 2214 exhibits a substantially spherical shape. The discrete hard material particles may be monodisperse, wherein each of the discrete hard material particles exhibits substantially the same material composition, size, and shape, or may be polydisperse, wherein at least one of the discrete hard material particles exhibits one or more of a different material composition, a different particle size, and a different shape than at least one other of the discrete hard material particles. The hard material powder 2214 may be formed by conventional processes, which are not described herein.

The Re-containing structure(s) 2204 may exhibit configurations (e.g., sizes, shapes, material compositions, material distributions, orientations, arrangements) and positions within the hard material powder 2214 substantially similar to the configurations and positions of one or more of the Re-containing structures 104, 204, 304, 404, 504, 604, 704, 804, 904, 1004, 1104, 1204, 1304, 1404, 1504, 1604, 1704, 1804, 1904, 2004, 2104 previously described with reference to FIGS. 1 through 21, respectively.

The supporting substrate 2203 may exhibit a configuration substantially similar to the configuration of the supporting substrate 2103 previously described with reference to FIG. 21. As shown in FIG. 22A, in some embodiments, the Re-containing structure(s) 2204 are contained within the longitudinal boundaries of the hard material powder 2214, such that portions of the Re-containing structure(s) 2204 do not longitudinally extend into the supporting substrate 2203. In additional embodiments, one or more of the Re-containing structure(s) 2204 may be positioned to longitudinally extend into the supporting substrate 2203. For example, the supporting substrate 2203 may be subjected to one or more material removal processes (e.g., one or more etching processes, such as one or more laser etching processes) to form a desired pattern of trenches (e.g., openings, perforations) in the supporting substrate 2203, and then the Re-containing structure(s) 2204 may be provided within the trenches. In such embodiments, the Re-containing structure(s) 2204 may be positioned to longitudinally extend into both the supporting substrate 2203 and the hard material powder 2214.

Referring next to FIG. 22B, the hard material powder 2214 (FIG. 22A), the Re-containing structures 2204, and the supporting substrate 2203 may be subjected to HTHP processing to form a cutting element 2201 including a cutting table 2200 attached to the supporting substrate 2203. The HTHP process may include subjecting the hard material powder 2214, the Re-containing structures 2204, and the supporting substrate 2203 to elevated temperatures and elevated pressures in a heated press for a sufficient time to inter-bond the discrete hard material particles of the hard material powder 2214. Although the exact operating parameters of HTHP processes will vary depending on the particular compositions and quantities of the various materials being sintered, pressures in the heated press may be greater than or equal to about 5.0 GPa, and temperatures may be greater than or equal to about 1,400° C. In some embodiments, the pressures in the heated press may be greater than or equal to about 6.5 gigapascals (GPa), such as greater than or equal to about 6.7 GPa. Furthermore, the materials and structures being sintered may be held at such temperatures and pressures for a time period between about 30 seconds and about 20 minutes.

Following formation, the cutting table 2200 may be subjected to additional processing. By way of non-limiting example, the cutting table 2200 may be subjected to at least material removal processes to remove material from at least a portion of the interstitial spaces among the inter-bonded grains of hard material 2202 of one or more regions of the cutting table 2200. For example, a leaching agent may be used to remove catalyst material from one or more regions of the cutting table 2200 to form a leached cutting table exhibiting one of the configurations previously described with reference to FIGS. 16 through 20. Suitable leaching agents are known in the art and described more fully in, for example, U.S. Pat. No. 5,127,923 to Bunting et al. (issued Jul. 7, 1992), and U.S. Pat. No. 4,224,380 to Bovenkerk et al. (issued Sep. 23, 1980), the disclosure of each of which is incorporated herein in its entirety by this reference. By way of non-limiting example, at least one of aqua regia (i.e., a mixture of concentrated nitric acid and concentrated hydrochloric acid), boiling hydrochloric acid, and boiling hydrofluoric acid may as a leaching agent. In some embodiments, the leaching agent may comprise hydrochloric acid at a temperature greater than or equal to about 110° C. Surfaces other than those to be leached, such as surfaces of the supporting substrate 2203 and/or predetermined surfaces of the cutting table 2200, may be covered (e.g., coated) with a protective material, such as a polymer material, that is resistant to etching or other damage from the leaching agent. Exposed (e.g., unmasked) surfaces of the cutting table 2200 to be leached may be brought into contact with the leaching agent by, for example, dipping or immersion. The leaching agent may be provided in contact with the exposed surfaces of the cutting table 2200 for a period of from about 30 minutes to about 60 hours, depending upon the size of the cutting table 2200 and a desired depth of material removal.

Figure 23:
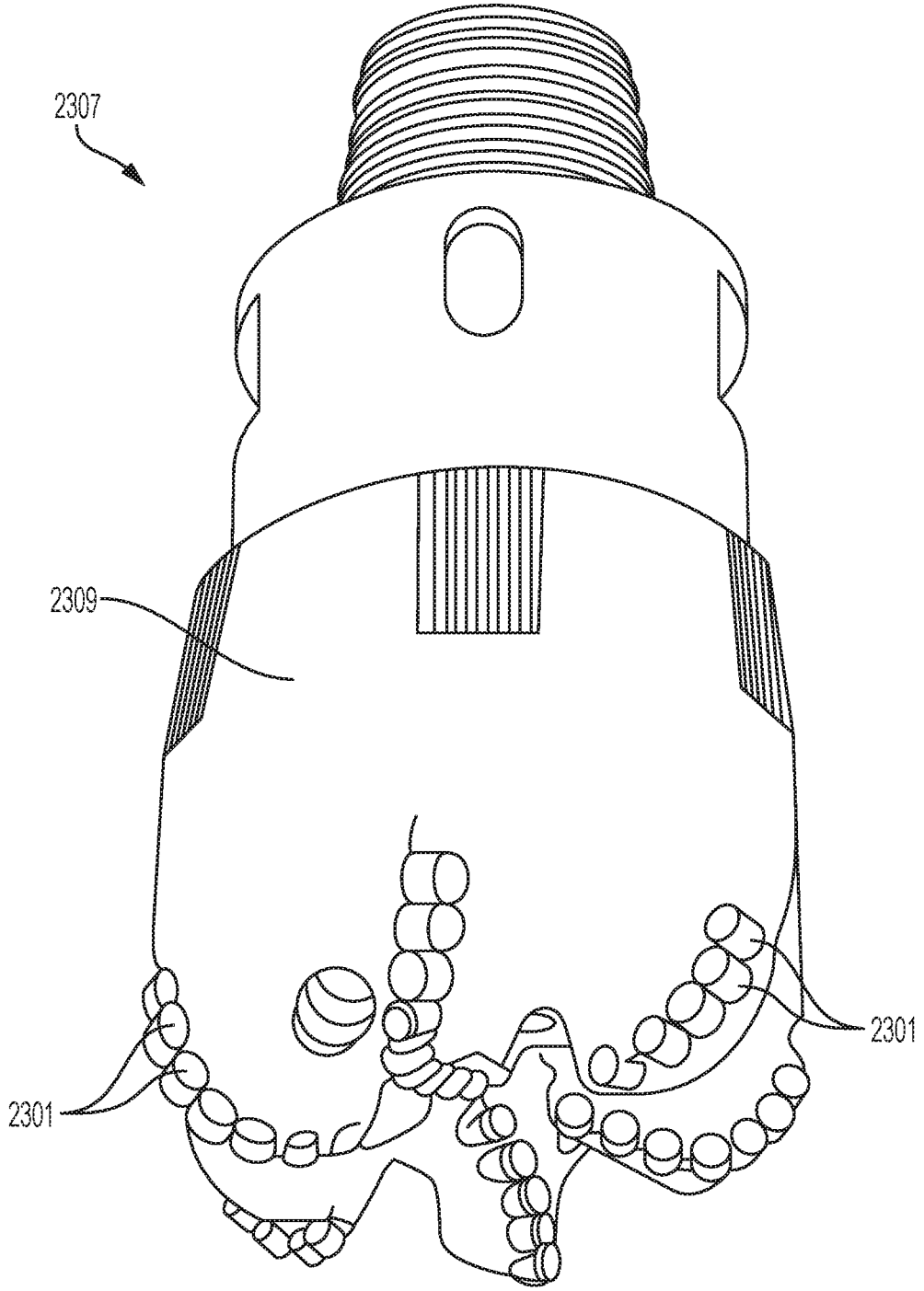
FIG. 23 is a perspective view of a fixed-cutter earth-boring rotary drill bit, in accordance with embodiments of the disclosure.

Cutting elements (e.g., the cutting element 2101 shown in FIG. 21) according to embodiments of the disclosure may be included in earth-boring tools of the disclosure. As a non-limiting example, FIG. 23 illustrates a rotary drill bit 2307 (e.g., a fixed-cutter rotary drill bit) including cutting elements 2301 secured thereto. The cutting elements 2301 may, for example, be attached (e.g., welded, brazed, etc.) to one or more blades of a bit body 2309 of the rotary drill bit 2307. The cutting elements 2301 may be substantially similar to the cutting element 2101 previously described herein with reference to FIG. 21. Each of the cutting elements 2301 may be substantially the same as each other of the cutting elements 2301, or at least one of the cutting elements 2301 may be different than at least one other of the cutting elements 2301.

During use and operation, the rotary drill bit 2307 may be rotated about a longitudinal axis thereof in a borehole extending into a subterranean formation. As the rotary drill bit 2307 rotates, at least some of the cutting elements 2301 provided in rotationally leading positions across the blades of the bit body 2309 may engage surfaces of the borehole with cutting edges thereof and remove (e.g., shear, cut, gouge, etc.) portions of the subterranean formation. After the cutting edge of at least one of the cutting elements 2301 is subjected to a predetermined amount of wear as a result of interactions with the subterranean formation, the cutting element 2301 may fail (e.g., fracture) at or proximate to one or more Re-containing structures adjacent the worn cutting edge, causing a section of the cutting table associated with the worn cutting edge to detach from the remainder of the cutting element 2301. The removal of the section associated with the worn cutting edge may form a new, relatively sharper cutting edge of the cutting element 2301. The drilling operation may then continue in a similar manner, with different Re-containing structures of the cutting element 2301 facilitating the formation of a new cutting edge after the cutting edge of a section adjacent to the perforation is subjected to a predetermined amount of wear within the borehole.

The cutting tables, cutting elements, and earth-boring tools of the disclosure may exhibit increased performance, reliability, and durability as compared to conventional cutting tables, conventional cutting elements, and conventional earth-boring tools. The configurations of the cutting tables of the disclosure (e.g., including the configurations and positions of the Re-containing structures thereof) advantageously facilitate and maintain aggressive cutting of a subterranean formation through a combination of self-sharpening characteristics and selective formation engagement. The cutting tables, cutting elements, earth-boring tools, and methods of the disclosure may provide enhanced drilling efficiency as compared to conventional cutting tables, conventional cutting elements, conventional earth-boring tools, and conventional methods.

While the disclosure is susceptible to various modifications and alternative forms, specific embodiments have been shown by way of example in the drawings and have been described in detail herein. However, the disclosure is not intended to be limited to the particular forms disclosed. Rather, the disclosure is to cover all modifications, equivalents, and alternatives falling within the scope of the disclosure as defined by the following appended claims and their legal equivalents.

What is claimed is:

1. A cutting table, comprising:

a polycrystalline hard material; and at least one rhenium-containing structure embedded within and completely surrounded by the polycrystalline hard material and comprising greater than or equal to about 10 weight percent rhenium, the at least one rhenium-containing structure longitudinally offset from upper and lower longitudinal boundaries of the polycrystalline hard material.

2. The cutting table of claim 1, wherein the at least one rhenium-containing structure comprises at least one rhenium-containing alloy comprising rhenium and at least one refractory metal.

3. The cutting table of claim 1, wherein the at least one rhenium-containing structure comprises a single, substantially continuous elongate structure.

4. The cutting table of claim 1, wherein the at least one rhenium-containing structure comprises a group of relatively smaller, discrete structures positioned proximate one another to form a relatively larger, elongate structure substantially free of bonds directly coupling the relatively smaller, discrete structures to one another.

5. The cutting table of claim 1, wherein the at least one rhenium-containing structure comprises a plurality of rhenium-containing structures extending in one or more substantially non-linear paths within the hard material.

6. The cutting table of claim 5, wherein the plurality of rhenium-containing structures comprises multiple rhenium-containing structures substantially aligned with one another along a single radial position.

7. The cutting table of claim 5, wherein the plurality of rhenium-containing structures comprises:

at least one first rhenium-containing structure extending in a first non-linear path; and at least one second rhenium-containing structure laterally offset from the at least one first rhenium-containing structure and extending in a second non-linear path.

8. The cutting table of claim 1, wherein the at least one rhenium-containing structure comprises a single rhenium-containing structure extending substantially continuously in an arcuate path within the hard material.

9. The cutting table of claim 1, wherein the at least one rhenium-containing structure comprises a plurality of rhenium-containing structures extending in one or more substantially linear paths within the hard material.

10. The cutting table of claim 1, wherein the at least one rhenium-containing structure comprises:

at least one first rhenium-containing structure extending in a non-linear path within the hard material; and at least one second rhenium-containing structure extending in a substantially linear path within the hard material.

11. The cutting table of claim 1, wherein the at least one rhenium-containing structure is oriented non-perpendicular to an upper longitudinal boundary of the hard material.

12. The cutting table of claim 1, wherein the polycrystalline hard material comprises a polycrystalline material including at least two regions having one or more of different average grain sizes and different grain size distributions than one another.

13. The cutting table of claim 1, wherein the polycrystalline hard material exhibits inter-bonded hard material particles and interstitial spaces between the inter-bonded hard material particles, at least some regions of the polycrystalline hard material substantially free of catalyst material within the interstitial spaces thereof.

14. The cutting table of claim 1, further comprising at least one perforation longitudinally extending into the hard material and longitudinally overlying the at least one rhenium-containing structure.

15. A cutting element, comprising: a supporting substrate; and a cutting table over the supporting substrate and comprising: a polycrystalline hard material; and at least one rhenium-containing structure comprising greater than or equal to about 10 weight percent rhenium embedded within and completely surrounded by the polycrystalline hard material the at least one rhenium-containing structure longitudinally offset from upper and lower longitudinal boundaries of the polycrystalline hard material.

16. An earth-boring tool comprising the cutting element of claim 15.

17. A method of forming a cutting element, comprising:

providing at least one rhenium-containing structure comprising greater than or equal to about 10 weight percent rhenium within a hard material powder comprising discrete hard material particles, the at least one rhenium-containing structure embedded in and completely surrounded by the hard material powder;

providing a supporting substrate adjacent to the hard material powder; and subjecting the supporting substrate, the at least one rhenium-containing structure, and the hard material powder to elevated temperatures and elevated pressures to inter-bond the discrete hard material particles of the hard material powder and form a cutting table attached to the supporting substrate, the cutting table comprising a polycrystalline hard material and the at least one rhenium-containing structure embedded within and completely surrounded by the polycrystalline hard material such that the at least one rhenium-containing structure is longitudinally offset from upper and lower longitudinal boundaries of the polycrystalline hard material.

18. A cutting element, comprising:

a supporting substrate; and the cutting table of claim 1 attached to the supporting substrate.

* * * * *